US006914497B2

(12) United States Patent
Sano et al.

(10) Patent No.: US 6,914,497 B2
(45) Date of Patent: Jul. 5, 2005

(54) PARALLEL MULTISTAGE BAND-PASS FILTER

(75) Inventors: Yasushi Sano, Kawasaki (JP); Eiichi Kobayashi, Takatsuki (JP); Shingo Okajima, Ishikawa-gun (JP); Jun Hattori, Takatsuki (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 10/647,504

(22) Filed: Aug. 26, 2003

(65) Prior Publication Data

US 2004/0041635 A1 Mar. 4, 2004

(30) Foreign Application Priority Data

Aug. 30, 2002 (JP) ..... 2000-254445

(51) Int. Cl.[7] ..... H01P 1/20

(52) U.S. Cl. ..... 333/175; 333/202; 333/204; 333/206

(58) Field of Search ..... 333/167, 168, 333/173–176, 202

(56) References Cited

U.S. PATENT DOCUMENTS 5,184,096 A * 2/1993 Wakino et al. ..... 333/175
5,502,421 A * 3/1996 Nakahara ..... 333/167
6,512,427 B2 * 1/2003 Nakano ..... 333/132
6,518,854 B2 * 2/2003 Kayano et al. ..... 333/99 S
6,621,370 B1 * 9/2003 Dao ..... 333/25

FOREIGN PATENT DOCUMENTS

| | | |
|---|---|---|
| EP | 1148576 A2 | 10/2001 |
| GB | 1062269 | 3/1967 |
| JP | 03-072701 | 3/1991 |

* cited by examiner

*Primary Examiner*—Seungsook Ham
(74) *Attorney, Agent, or Firm*—Dickstein, Shapiro, Morin & Oshinsky, LLP.

(57) ABSTRACT

In a parallel multistage band-pass filter, a transmission line having an electrical length substantially equal to half ($\lambda/2$) of the wavelength of the transmission signal is incorporated between the port on the input terminal side of the odd number (2n−1)th resonator numbered from the input terminal side and the port on the input terminal side of the even number (2n)th resonator numbered from the input terminal side; and a transmission line having an electrical length substantially equal to $\lambda/2$ is incorporated between the port on the output terminal side of the even number (2n)th resonator numbered from the input terminal side and the port on the output terminal side of the odd number (2n+1)th resonator numbered from the input terminal side. Moreover, a transmission line for adjustment of a transmission phase between the input terminal and the output terminal is incorporated between the first resonator numbered from the output terminal side and the output terminal.

20 Claims, 23 Drawing Sheets

FIG. 8A

| | TRANSMISSION ROUTE | NUMBER OF λ/2 TRANSMISSION LINE | PHASE RELATION |
|---|---|---|---|
| a | 101→201→202 | 0 | REVERSED PHASE |
| b | 101→102→202 | 1 | |
| c | 102→202→203 | 1 | REVERSED PHASE |
| d | 102→103→203 | 0 | |

FIG. 8B

| | TRANSMISSION ROUTE | NUMBER OF λ/2 TRANSMISSION LINE | PHASE RELATION |
|---|---|---|---|
| a | 101'→201'→202' | 0 | REVERSED PHASE |
| b | 101'→102'→202' | 1 | |
| c | 102'→202'→203' | 1 | REVERSED PHASE |
| d | 102'→103'→203' | 0 | |

FIG. 8C

| | TRANSMISSION ROUTE | NUMBER OF λ/2 TRANSMISSION LINE | PHASE RELATION |
|---|---|---|---|
| a | 101"→201"→202" | 1 | REVERSED PHASE |
| b | 101"→102"→202" | 2 | |
| c | 102"→202"→203" | 2 | REVERSED PHASE |
| d | 102"→103"→203" | 1 | |

FIG. 8D

| | TRANSMISSION ROUTE | NUMBER OF λ/2 TRANSMISSION LINE | PHASE RELATION |
|---|---|---|---|
| a | 101→201→202→203 | 1 | a-b REVERSED PHASE |
| b | 101→102→202→203 | 2 | a-c IN-PHASE |
| c | 101→102→103→203 | 1 | |

FIG. 8E

| | TRANSMISSION ROUTE | NUMBER OF λ/2 TRANSMISSION LINE | PHASE RELATION |
|---|---|---|---|
| a | 101'→201'→202'→203' | 0 | a-b REVERSED PHASE |
| b | 101'→102'→202'→203' | 1 | a-c IN-PHASE |
| c | 101'→102'→103'→203' | 0 | |

FIG. 8F

| | TRANSMISSION ROUTE | NUMBER OF λ/2 TRANSMISSION LINE | PHASE RELATION |
|---|---|---|---|
| a | 101"→201"→202"→203" | 2 | a-b REVERSED PHASE |
| b | 101"→102"→202"→203" | 3 | a-c IN-PHASE |
| c | 101"→102"→103"→203" | 2 | |

PARALLEL MULTISTAGE BAND-PASS FILTER

BACKGROUND OF THE INVENTION

Field of the Invention

The present invention relates to a transmission-reception band-pass filter for use in mobile communication base stations of mobile communication systems or the like.

In recent years, the number of users has been increased, and application areas have been spread in mobile communication systems such as portable telephones or the like, and thus, more base stations have been needed. Referring to devices which are commonly used for transmission in the base stations, the size, the loss and the cost have been required to be reduced.

Filters of transmission devices commonly-used in the base stations are composed of band-pass filters (BPF), respectively, which permit only signals in a required frequency band to be transmitted.

To ensure a wide pass-band for the above-described band-pass filters, a method is available, in which resonators having adjacent resonance frequencies are connected in series with each other so that the resonance frequency band width is increased. However, when a plurality of resonators are connected in series with each other, the intrinsic modes of the resonators appear in the frequency components, respectively. Hence, the group delay characteristic for each resonance frequency cannot be desirably set, and a group delay characteristic curve having a flat portion ranging over the pass band can not be obtained.

To solve this problem, there has been devised a band-pass filter having a multistage configuration in which a plurality of resonators are connected in parallel to each other as shown in FIG. 22.

FIG. 22 is an equivalent circuit diagram of a related art multistage band-pass filter. An input terminal 1, an output terminal 2, and resonators F1 to Fm, and transmission lines for phase-adjustment TL are shown in FIG. 22. In this example, an even number of resonators are provided.

Referring to the parallel multistage band-pass filter shown in FIG. 22, the resonators F1 to Fm having adjacent resonance frequencies are connected in parallel to each other between the input terminal 1 and the output terminal 2. A phase-adjustment circuit (transmission line) having an electrical length substantially equal to half of the wavelength of a transmission signal is connected to the port on the output terminal side of the (2n)th resonator numbered from the input terminal side.

However, in practical formation of this circuit, it is very difficult to connect a plurality of the resonators at one point on the input and output terminal sides, respectively, as shown in FIG. 22.

To solve this problem, the invention has been disclosed in Japanese Unexamined Patent Application Publication No. 3-72701.

FIG. 23 shows a typical one of the parallel multistage band-pass filters disclosed in the above-mentioned invention. FIG. 23 is an equivalent circuit diagram of the related art parallel three-stage type band-pass filter. An input terminal 1, an output terminal 2, resonators F1 to F3 having resonance frequencies adjacent to each other, and transmission lines TL are shown in FIG. 23.

A plurality of the resonators F1, F2, and F3 having adjacent resonance frequencies are connected in parallel to each other between the input terminal 1 and the output terminal 2 for a transmission signal, as shown in FIG. 23. Transmission lines TL each having an electrical length substantially equal to half of the wavelength of a transmission signal are incorporated between the ports on the input terminal side of the resonators F1 and F2, and the input terminal 1. A transmission line TL having an electrical length substantially equal to half of the wavelength of a transmission signal is connected in series with the port on the output terminal side of the resonator 2.

Such related art parallel multistage band-pass filters as described above have the following problems to be solved.

In the case in which the respective resonators are connected in parallel to each other in the related art parallel multistage band-pass filters, the connection must be carried out after the phases and the characteristic impedances of the transmission lines to be connected to the resonators are adjusted for suppression of a loss. Accordingly, the cost is increased due to the adjustment. Moreover, the number of necessary parts is increased, since the adjusted transmission lines must be connected to both of the input-output ports of the resonators.

The phases at neighboring resonators must also be inverted. In the case in which the phases can not be inverted by the excitation elements of the resonators, a phase-inversion element having an electrical length equal to the wavelength of a transmission signal multiplied by an odd number must be connected between both of the ports of the resonators. Thus, the configuration of the filter becomes complicated, and the number of necessary parts is increased.

As seen in the above-description, the number of parts is large. Thus, when the number of stages is increased, the arrangement of the resonators and the transmission lines becomes complicated. Accordingly, it is difficult to form the filter.

Further, when the number of stages is increased, the insertion loss of the filter is increased, due to the loss caused by the transmission lines.

SUMMARY OF THE INVENTION

It is an object of the present invention to provide a parallel multistage bandpass filter of which the number of parts is small, and which can be easily formed.

According to a first aspect of the present invention, there is provided a parallel multistage band-pass filter which comprises: a plurality of resonators having adjacent resonance frequencies and connected in parallel to each other between an input terminal and an output terminal for a transmission signal; a transmission line having an electrical length substantially equal to half of the wavelength of the transmission signal incorporated between the port on the input terminal side of the (2n−1)th resonator numbered from the input terminal side and the port on the input terminal side of the (2n)th resonator numbered from the input terminal side; and a transmission line having an electrical length substantially equal to half of the wavelength of the transmission signal incorporated between the port on the output terminal side of the (2n)th resonator numbered from the input terminal side and the port on the output terminal side of the (2n+1)th resonator numbered from the input terminal side, in which n is a natural number.

According to a second aspect of the present invention, there is provided a parallel multistage band-pass filter which comprises: a plurality of resonators having adjacent resonance frequencies and connected in parallel to each other between an input terminal and an output terminal for a transmission signal; a transmission line having an electrical length substantially equal to half of the wavelength of the transmission signal incorporated between the port on the output terminal side of the (2n−1)th resonator numbered from the output terminal side and the port on the output terminal side of the (2n)th resonator numbered from the output terminal side; and a transmission line having an electrical length substantially equal to half of the wavelength of the transmission signal incorporated between the port on the input terminal side of the (2n)th resonator numbered from the output terminal side and the port on the input terminal side of the (2n+1)th resonator numbered from the output terminal side, in which n is a natural number. Advantageously, the parallel multistage band-pass filter has a simple configuration, and can be easily formed. Moreover, the insertion loss can be reduced, due to the simple configuration.

Preferably, at least one reactance element is connected between the ports at both the input terminal and output terminal ends of the transmission lines and ground. Accordingly, the transmission phase between the input terminal and the output terminal of the parallel multistage band-pass filter can be easily adjusted.

Preferably, reactance elements are connected in series with the excitation elements of the resonators. Thus, the resonators and the transmission lines can be easily matched with each other.

The transmission line can be a dielectric coaxial line, a microstrip line, or a lumped constant line comprising an inductance element and a capacitance element.

When the transmission line is a microstrip line, a parallel multistage band-pass filter having a small size can be produced at a low cost.

When the transmission line is a lumped constant line comprising an inductance element and a capacitance element, a small-sized parallel multistage band-pass filter can be formed.

The resonator can be any type of resonator, such as a dielectric coaxial resonator or a microstrip resonator.

When the resonator is a dielectric coaxial resonator, the configuration of the resonators can be simplified and a small-sized parallel multistage band-pass filter can be formed.

When the resonator is a microstrip resonator, a parallel multistage band-pass filter having a simple configuration can be produced at a low cost.

In one aspect, the present invention provides a composite filter device which comprises a plurality of the above-described parallel multistage band-pass filters. Accordingly, a composite filter having a simple configuration can be produced at a low cost.

In a further aspect, the present invention provides an amplifier device which includes the above-described parallel multistage band-pass filter.

Preferably, the present invention provides a communication device which includes the above-described parallel multistage band-pass filter, the above-described composite filter, or the above-described amplifier device. Thus, the communication device can be produced at a low cost.

BRIEF DESCRIPTION OF THE DRAWINGS

FIG. 8A shows relations between the phases at predetermined positions which are between the input terminal and the output terminal of the parallel three-stage bandpass filter of the first embodiment;

FIG. 8B shows relations between the phases at predetermined positions which are between the input terminal and the output terminal of the related art parallel three-stage band-pass filter;

FIG. 8C shows relations between the phases at predetermined positions which are between the input terminal and the output terminal of the another related art parallel three-stage band-pass filter;

FIG. 8D shows relations between the phases at other predetermined positions which are between the input terminal and the output terminal of the parallel three-stage band-pass filter of the first embodiment;

FIG. 8E shows relations between the phases at other predetermined positions which are between the input terminal and the output terminal of the related art parallel three-stage band-pass filter;

FIG. 8F shows relations between the phases at other predetermined positions which are between the input terminal and the output terminal of the another related art parallel three-stage band-pass filter;

DESCRIPTION OF THE PREFERRED EMBODIMENTS

The configuration of a parallel multistage band-pass filter according to a first embodiment of the present invention will be described with reference to FIGS. 1 to 8F.

Figure 1:
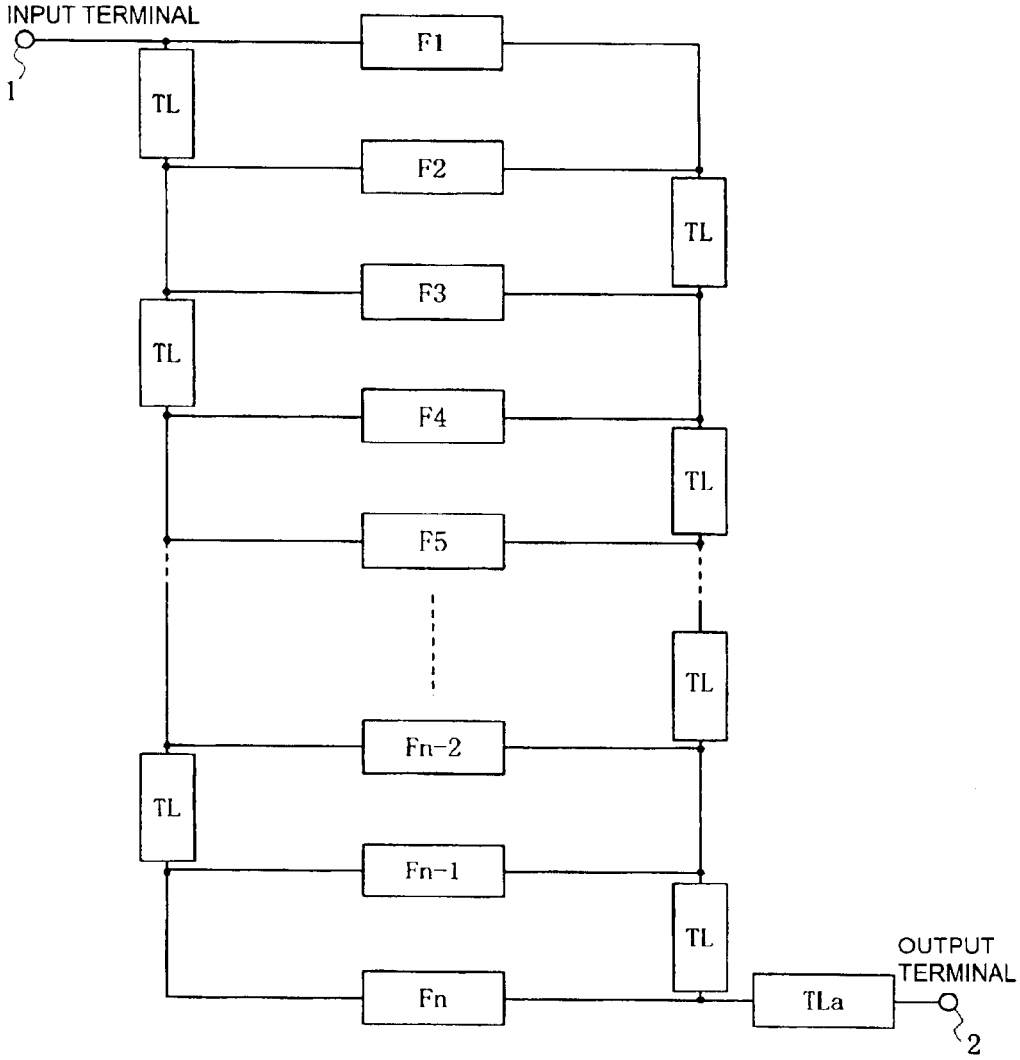
FIG. 1 is an equivalent circuit diagram of a parallel multistage band-pass filter having an odd number of resonators, according to a first embodiment of the present invention.
Figure 2:
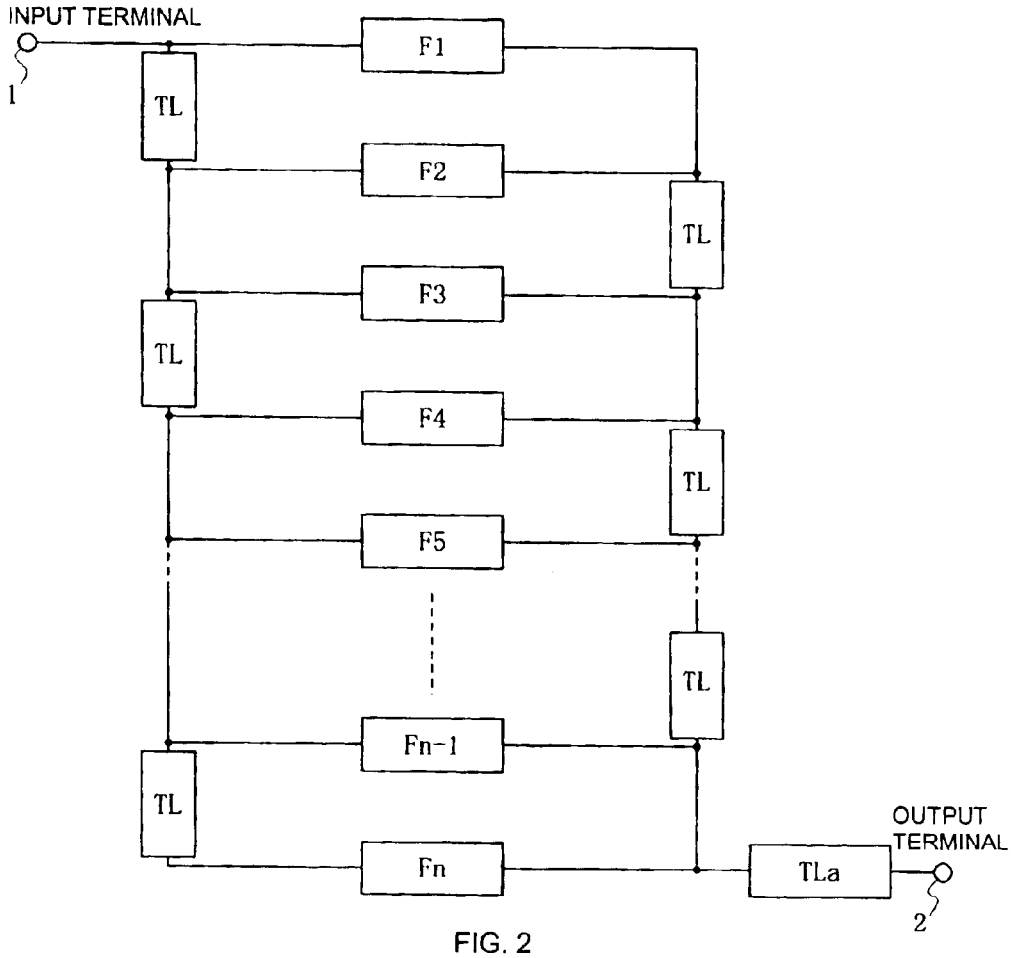
FIG. 2 is an equivalent circuit diagram of a parallel multistage band-pass filter having an even number of resonators, according to the first embodiment of the present invention.

FIG. 1 is an equivalent circuit diagram of the parallel multistage band-pass filter having an odd number of resonators. FIG. 2 is an equivalent circuit diagram of the parallel multistage band-pass filter having an even number of resonators.

Figure 3A:
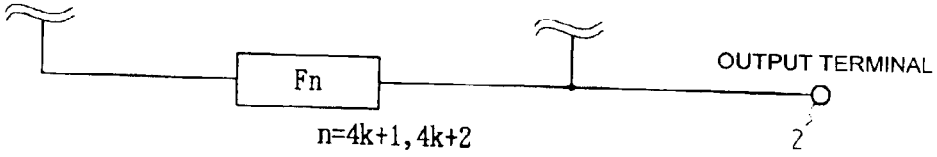
FIGS. 3A and 3B are equivalent circuit diagrams of the parallel multistage band-pass filters in the vicinity of the output terminals thereof, respectively.
Figure 3B:
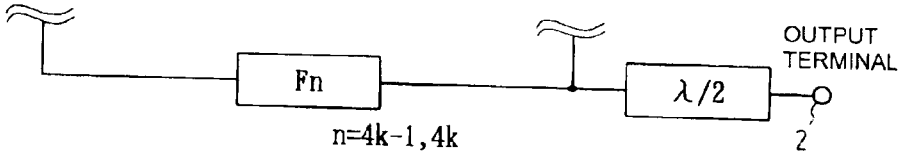

FIG. 3A and FIG. 3B are diagrams of the equivalent circuits near the output terminal. For FIG. 3A, the number of resonators is represented by 4k+1 and 4k+2, and for FIG. 3B, the number of resonators is represented by 4k−1, and 4k, in which k is a natural number.

An input terminal 1, an output 2, resonators F1 to Fn, and transmission lines TL and TLa each having an electrical length substantially equal to half of the wavelength of a transmission signal are shown in FIGS. 1, 2, 3A, and 3B, respectively.

As seen in FIGS. 1 and 2, a plurality of the resonators F1 to Fn having adjacent resonance frequencies are connected in parallel to each other between the input terminal 1 and the output terminal 2 via the transmission lines TL.

The parallel multistage band-pass filters will be described below, in which k and n are natural numbers, respectively.

Resonators F1 to Fn are arranged in that order from the input terminal 1 side. A transmission line TL having an electrical length substantially equal to half of the wavelength of a transmission signal is connected between the port on the input terminal side of the (2n−1)th resonator and the port on the input terminal side of the (2n)th resonator, which are numbered from the input terminal 1 side. Moreover, a transmission line TL having an electrical length substantially equal to half of the wavelength of the transmission signal is connected between the port on the output terminal side of the (2n)th resonator and the port on the output terminal side of the (2n+1)th resonator, which are numbered from the input terminal 1 side.

Furthermore, a transmission line TLa having an electrical length of λ/2 for adjustment of a transmission phase between the input terminal and the output terminal is incorporated between the first resonator Fn numbered from the output terminal 2 side, and the output terminal 2 (hereinafter, a transmission line having an electrical length of about λ/2 will be referred to as a λ/2 transmission line).

The transmission line TLa is preferably incorporated only when the number of resonators is 4K−1 or 4K, as shown in FIG. 3B. When the number of resonators is 2, 4K+1, or 4K+2, the transmission line TLa is preferably not incorporated, since the incorporation of one transmission line TLa gives a result equivalent to that of two series-connected transmission lines TLas. That is, the transmission phase is the same as that obtained when no transmission line TLa is incorporated.

Hereinafter, a parallel band-pass filter using three-stage resonators will be described with reference to FIGS. 4A to 4C, 5A, 5B, 6A, 6B, 7A, 7B, and 8A to 8F.

Figure 4A:
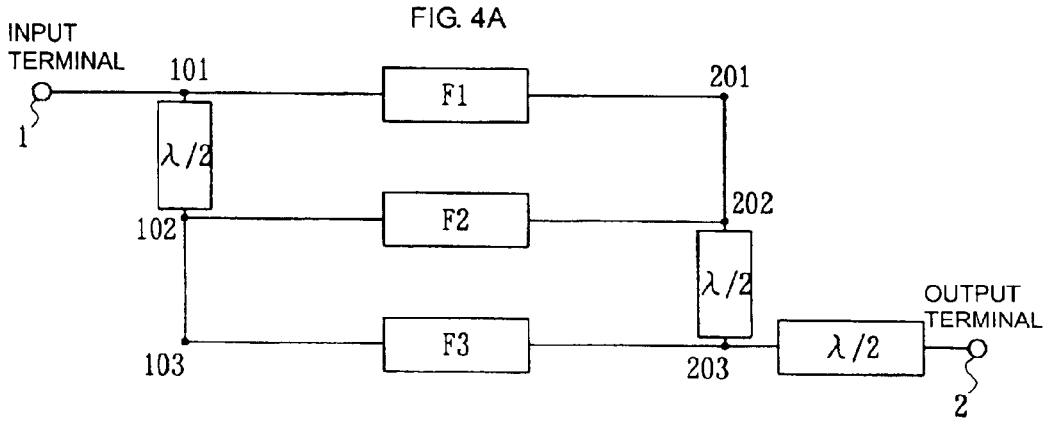
FIG. 4A is an equivalent circuit diagram of the parallel three-stage band-pass filter of the first embodiment.
Figure 4B:
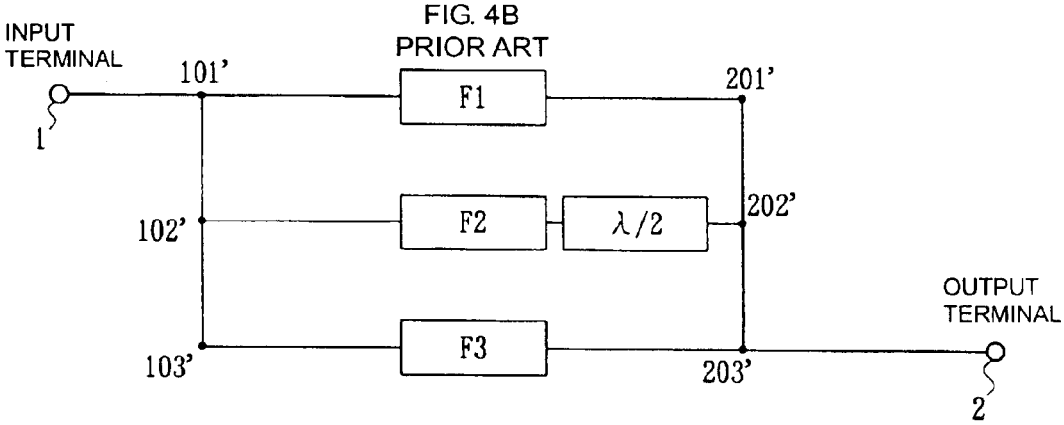
FIG. 4B PRIOR ART
FIG. 4B is an equivalent circuit diagram of a related art parallel three-stage band-pass filter.
Figure 4C:
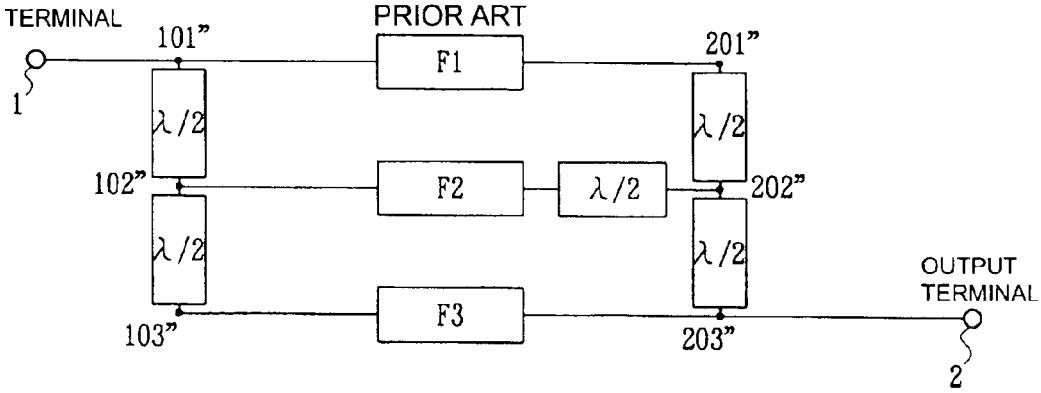
FIG. 4C PRIOR ART
FIG. 4C is an equivalent circuit diagram of another related art parallel three-stage band-pass filter.
Figure 22:
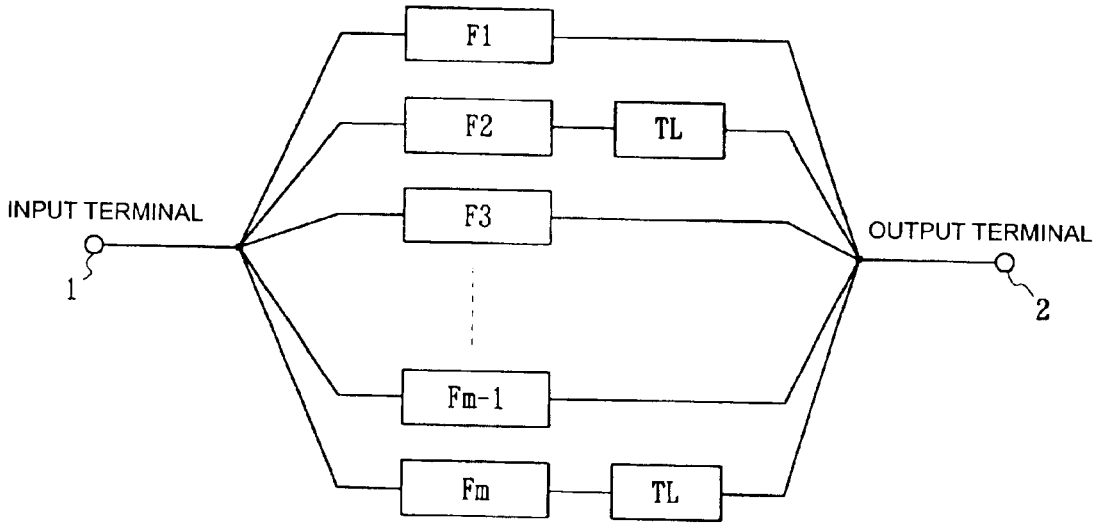
FIG. 22 PRIOR ART
FIG. 22 is an equivalent circuit diagram of a related art parallel multistage band-pass filter.
Figure 23:
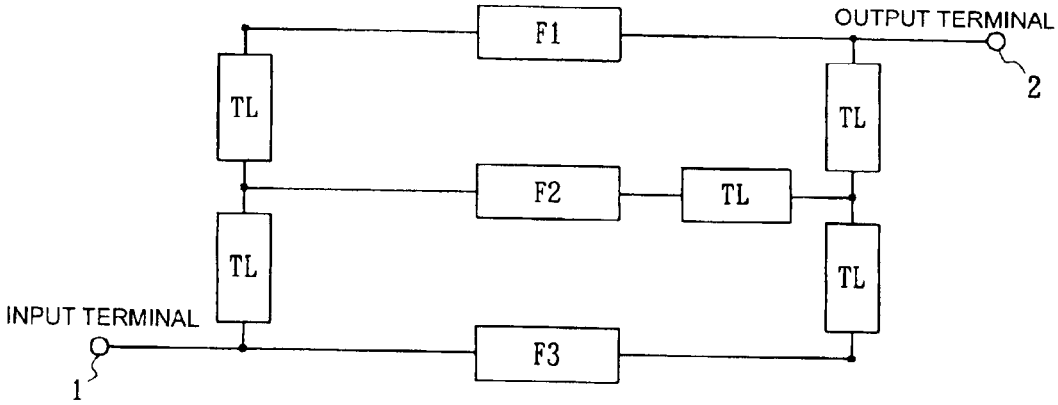
FIG. 23 PRIOR ART
FIG. 23 is an equivalent circuit diagram of another related art parallel multistage band-pass filter.

FIG. 4A is an equivalent circuit diagram of the band-pass filter of this embodiment of the present invention. FIG. 4B is the equivalent circuit diagram of the related art band-pass filter shown in FIG. 22. FIG. 4C is the equivalent circuit diagram of the related art band-pass filter shown in FIG. 23.

In FIGS. 4A, 4B, and 4C, an input terminal 1, an output terminal 2, and resonators F1, F2, and F3 are shown, and λ represents the wavelength of a transmission signal.

As shown in FIG. 4A, the resonators F1, F2, and F3 having adjacent resonance frequencies are connected in parallel to each other between the input terminal 1 and the output terminal 2.

A λ/2 transmission line is connected between the port 101 on the input terminal side of the resonator F1 and the port 102 on the input terminal side of the resonator F2. Also, a λ/2 transmission line is connected between the port 202 on the output terminal side of the resonator F2 and the port 203 on the output terminal side of the resonator F3. Moreover, a transmission line for adjustment of a transmission phase is incorporated between the port 203 on the output terminal side of the resonator F3 and the output terminal 2.

In the band-pass filter shown in FIG. 4B, the resonators F1, F2, and F3 are connected in parallel to each other between the input terminal 1 and the output terminal 2. A λ/2 transmission line is series-connected on the output terminal side of the resonator F2.

In the band-pass filter shown in FIG. 4C, the resonators F1, F2, and F3 are connected in parallel to each other between the input terminal 1 and the output terminal 2. With respect to all of the resonators, a λ/2 transmission line is connected between both of the ports of neighboring resonators. Moreover, a λ/2 transmission line is series-connected on the output terminal side of the resonator F2.

FIGS. 8A to 8F show the relations between the phases at particular positions in these band-pass filters.

FIGS. 8A, 8B, and 8C show relations between the phases at the port on the input terminal side of the resonator F1 and the port on the output terminal side of the resonator F2 and between the port on the input terminal side of the resonator F2 and the port on the output terminal side of the resonator F3, in the band-pass filters shown in FIGS. 4A, 4B, and 4C. FIGS. 8D to 8F show relations between the phases at the port on the input terminal side of the resonator F1 and the port on the output terminal side of the resonator F3 in the band-pass filters shown in FIGS. 4A to 4C, respectively.

As shown in FIGS. 8A to 8F, the phase relations between the band-pass filters are the same for any transmission route. Therefore, the band-pass filter having the above-described equivalent circuit according to this embodiment, although it has a simple configuration, has a superior group delay characteristic in a wide pass-band comparable to those of the related art parallel multistage band-pass filters. Since the band-pass filter of this embodiment can employ a simple configuration, the number of connection points between parts thereof is reduced, and the transmission loss can be decreased.

Referring to the band-pass filter shown in FIG. 4B, practically, the points 101', 102', and 103' overlap each other to form one point. Thus, it is difficult to form the circuit. For the band-pass filter shown in FIG. 4A, the circuit can be formed without the points 101, 102, and 103 being concentrated to one point. Thus, the circuit can be easily formed.

For the band-pass filter shown in FIG. 4C, many λ/2 transmission lines are used, and thus, the configuration of the circuit becomes complicated. On the other hand, the number of the λ/2 transmission lines of the band-pass filter shown in FIG. 4A is small. Thus, the circuit can be easily formed.

FIGS. 5A, 5B, 6A, 6B, 7A, and 7B show the equivalent circuits of band-pass filters comprising four-stage, five-stage, and six-stage resonators, respectively.

In FIGS. 5A to 7B, an input terminal 1, an output terminal 2, and resonators F1 to F6 having adjacent resonance frequencies are shown.

Figure 5A:
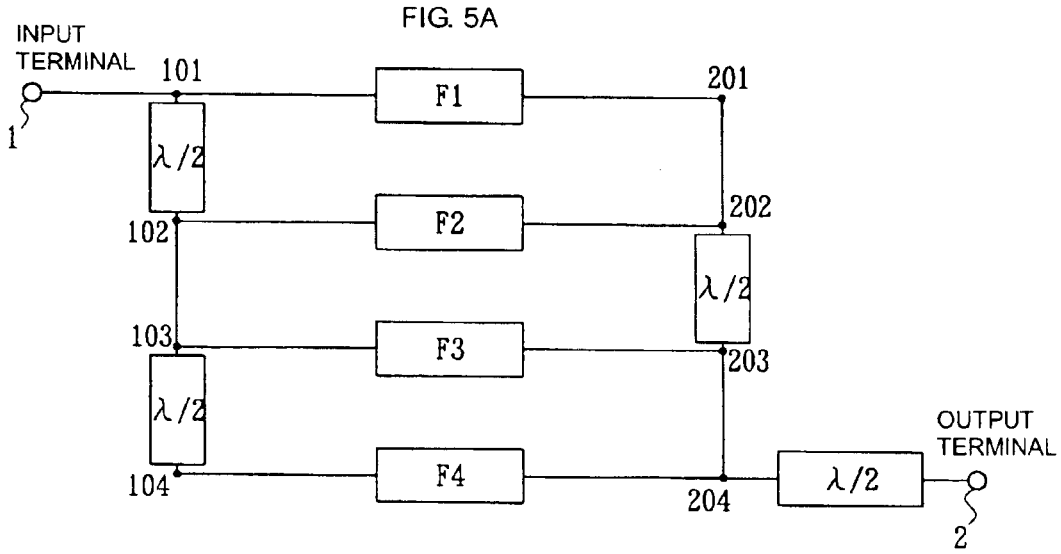
FIG. 5A is an equivalent circuit diagram of the parallel four-stage band-pass filter according to the first embodiment.
Figure 5B:
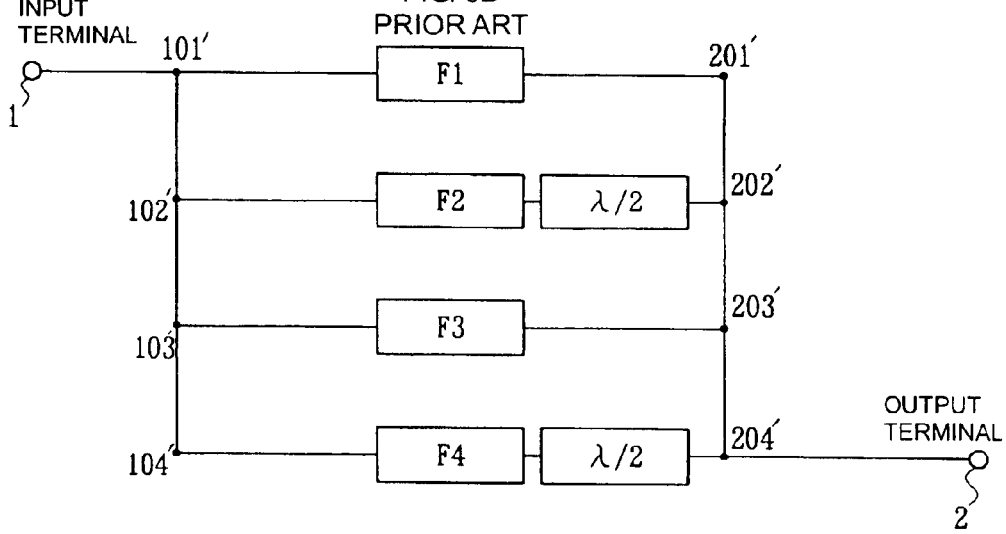
FIG. 5B PRIOR ART
FIG. 5B is an equivalent circuit diagram of the related art parallel four-stage band-pass filter.
Figure 6A:
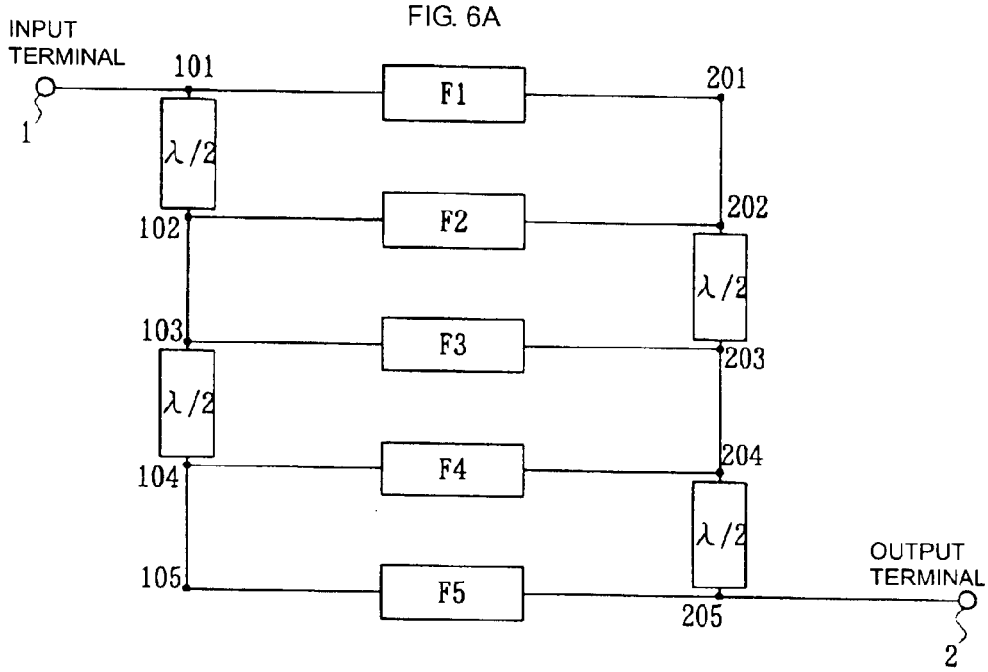
FIG. 6A is an equivalent circuit diagram of the parallel five-stage band-pass filter according to the first embodiment.
Figure 6B:
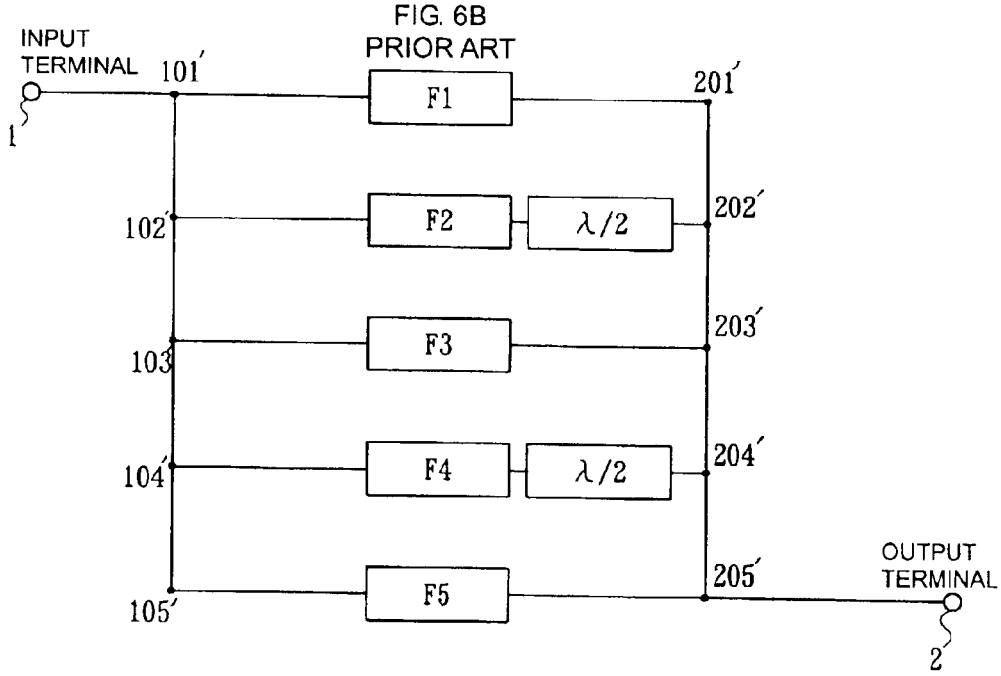
FIG. 6B PRIOR ART
FIG. 6B is an equivalent circuit diagram of the parallel five-stage band-pass filter of the related art parallel five-stage band-pass filter.
Figure 7A:
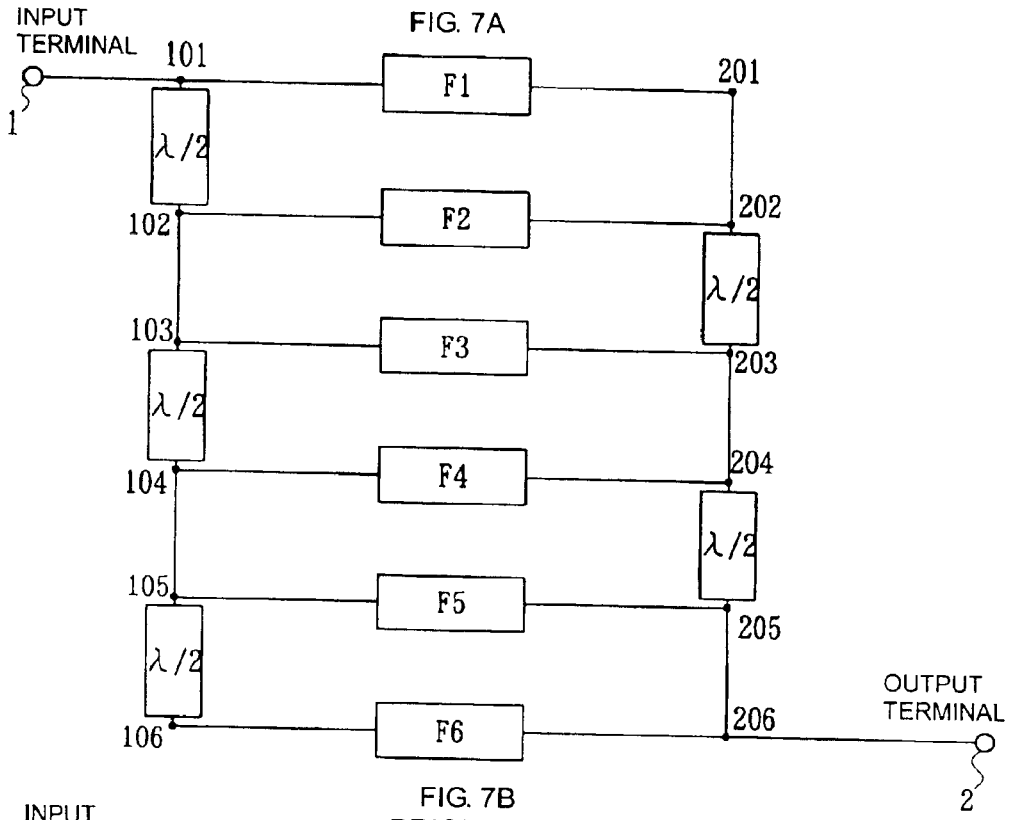
FIG. 7A is an equivalent circuit diagram of the parallel six-stage band-pass filter according to the first embodiment.
Figure 7B:
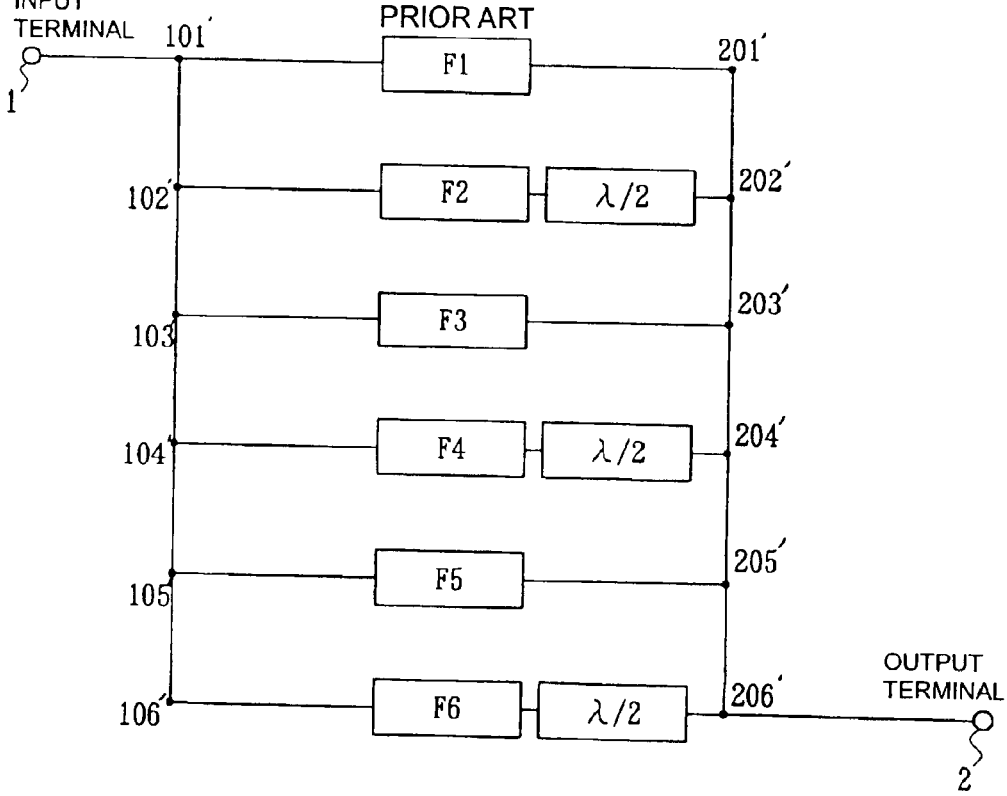
FIG. 7B PRIOR ART
FIG. 7B is an equivalent circuit diagram of the related art parallel six-stage band-pass filter.

FIGS. 5A, 6A, and 7A show the band-pass filters having the circuit configuration of this embodiment. FIGS. 5B, 6B, and 7B show the band-pass filters having the related art circuit configuration shown in FIG. 22.

According to the above-described configurations, the phase relations between the circuit-configurations of the related art and those of this embodiment are the same, respectively, as well as in the case of FIGS. 4A to 4C. Thus, a parallel multistage bandpass filter which has a simple structure, and can be easily formed is provided.

Hereinafter, examples of the structures of these parallel multistage band-pass filters will be described with reference to FIGS. 9A, 9B, and 9C.

Figure 9A:
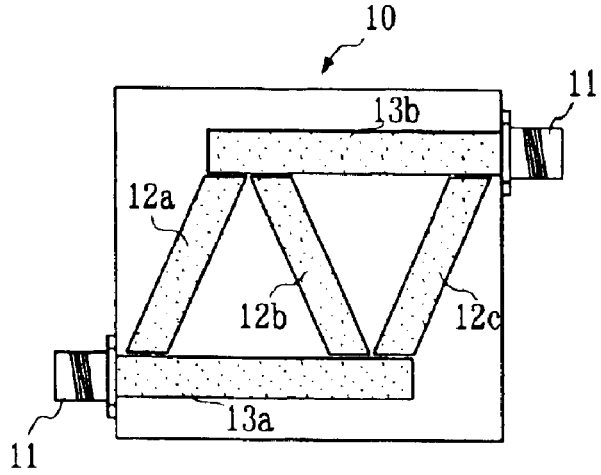
FIG. 9A is a schematic view showing the configuration of a parallel three-stage band-pass filter.

FIG. 9A schematically shows the structure of a parallel three-stage band-pass filter. FIG. 9B schematically shows the structure of a parallel four-stage band-pass filter. FIG. 9C schematically shows the structure of a parallel five-stage band-pass filter.

Figure 9B:
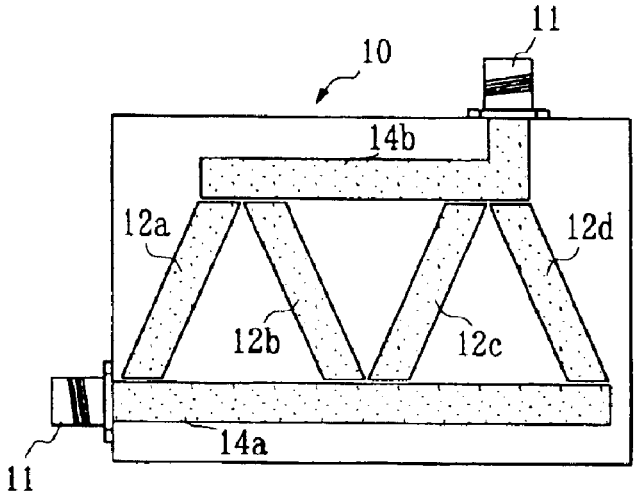
FIG. 9B is a schematic view showing the configuration of a parallel four-stage band-pass filter.
Figure 9C:
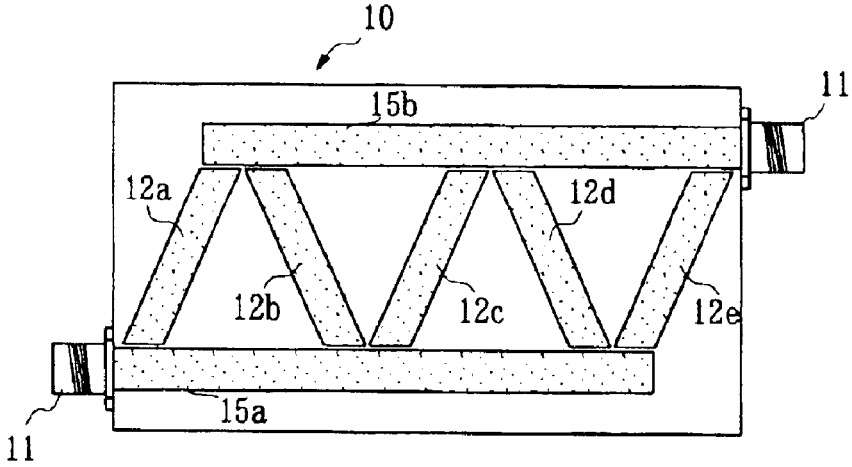
FIG. 9C is a schematic view showing the configuration of a parallel five-stage band-pass filter.

In FIGS. 9A, 9B, and 9C, a band-pass filter 10, a coaxial connector 11, microstrip resonators 12*a* to 12*e*, and strip lines 13*a*, 13*b*, 14*a*, 14*b*, 15*a*, and 15*b* are shown.

As shown in FIG. 9A, the coaxial connectors 11 are disposed on the two opposite surfaces of a case. In the case, the strip lines 13*a* and 13*b* having an electrical length substantially equal to half of the wavelength of a transmission signal are arranged so as to be connected to the coaxial connectors, respectively, and moreover, the microstrip resonators 12*a*, 12*b*, and 12*c* each having an electrical length equal to half of the wavelength of the transmission signal are arranged between the strip coaxial lines 13*a* and 13*b*.

The microstrip resonators 12*a*, 12*b*, and 12*c* are formed so as to have adjacent resonance frequencies.

The end on the strip line 13*a* side of the microstrip resonator 12*a* is connected to the end on the connector 11 side of the strip line 13*a*. The end on the strip line 13*b* side of the microstrip resonator 12*c* is connected to the end on the connector 11 side of the strip line 13*b*. The ends of microstrip resonator 12*a* and the microstrip resonator 12*b* which are on the strip line 13*b* side are connected to the end of the strip line 13*b* which is opposite to the end on the connector 11 side of the strip line 13*b*. Moreover, the ends of the microstrip resonator 12*b* and the microstrip resonator 12*c* which are on the strip line 13*a* side are connected to the end of the strip line 13*a* which is opposite to the end on the connector 11 side of the strip line 13*a*.

The above-described configuration is equivalent to that of the equivalent circuit shown in FIG. 4A except that the λ/2 transmission line inserted between the resonator F3 and the output terminal 2 is removed. It is to be noted that the λ/2 transmission line can be omitted from the band-pass filter structure by providing a phase-adjusting means in a circuit in a later stage to which this filter is connected.

Moreover, a parallel multistage band-pass filter which is small in size and has a simple configuration, can be produced at a low cost, since the transmission lines and the resonators are formed of strip lines.

In the parallel four-stage band-pass filter shown in FIG. 9B, the microstrip resonators 12*a* to 12*d* function as λ/2 resonators, the strip line 14*b* is formed so as to have an electrical length of λ/2, and the strip line 14*a* is formed so as to have an electrical length of λ.

The microstrip resonators 12*a* to 12*d* are formed so as to have adjacent resonance frequencies and arranged between the strip lines 14*a* and 14*b*.

The end on the strip line 14*a* side of the microstrip resonator 12*a* is connected to the end on the connector 11 side of the strip line 14*a*. The ends of the microstrip resonator 12*c* and the microstrip resonator 12*d* which are on the strip line 14*b* side are connected to the end on the connector 11 side of the strip line 14*b*.

The ends of the microstrip resonator 12*a* and the microstrip resonator 12*b* which are on the strip line 14*b* side are connected to the end of the strip line 14*b* which is opposite to the end on the connector 11 side of the strip line 14*b*. The ends of the microstrip resonator 12*b* and the microstrip resonator 12*c* which are on the strip line 14*a* side are connected to the middle point of the strip line 14*a*. The end on the strip line 14*a* side of the microstrip resonator 12*d* is connected to the end of the strip line 14*a* which is opposite to the end on the connector 11 side of the strip line 14*a*. The strip line 14*a* is a transmission line having an electrical length of λ. The microstrip resonator 12*b* and 12*c* are connected to the middle point of the strip line 14*a*. Thus, the ends of the microstrip resonator 12*a* and the microstrip resonator 12*b* are connected via the λ/2 transmission line, and the ends of the microstrip resonator 12*b* and the microstrip resonator 12*d* are connected via the λ/2 transmission line.

Thus, the band-pass filter 10, which corresponds to the equivalent circuit shown in FIG. 4B, is formed.

In the parallel five-stage band-pass filter shown in FIG. 9C, the microstrip resonators 12*a* to 12*e* function as λ/2 resonators, and the strip line 15*a* and 15*b* are formed so as to have an electrical length of λ.

The microstrip resonators 12*a* to 12*e* are formed so as to have adjacent resonance frequencies and arranged between the strip lines 15*a* and 15*b*.

The end on the strip line 15*a* side of the microstrip resonator 12*a* is connected to the end on the connector 11 side of the strip line 15*a*. The end on the strip line 15*b* of the microstrip resonator 12*e* is connected to the end on the connector 11 side of the strip line 15*b*.

The ends of the microstrip resonator 12*a* and the microstrip resonator 12*b* which are on the strip line 15*b* side are connected to the end of the strip line 15*b* which is opposite to the end on the connector 11 side of the strip line 15*b*. The ends of the microstrip resonator 12*b* and the microstrip resonator 12*c* which are on the strip line 15*a* side are connected to the middle point of the strip line 15*a*. The ends of the microstrip resonator 12*c* and the microstrip resonator 12*d* which are on the strip line 15*b* side are connected to the middle point of the strip line 15*b*. Moreover, the ends of the microstrip resonator 12*d* and the microstrip resonator 12*e* which are on the strip line 15*a* side are connected to the end of the strip line 15*a* which is opposite to the end on the connector 11 side of the strip line 15*a*. The strip line 15*a* is a transmission line having an electrical length of λ. The microstrip resonators 12*b* and 12*c* are connected to the middle point of the strip line 15*a*. Thus, the ends of the microstrip resonator 12*a* and the microstrip resonator 12*b* are connected to each other via the λ/2 transmission line. The ends of the microstrip resonator 12*c* and the microstrip resonator 12*d* are connected to each other via the λ/2 transmission line. Similarly, the strip line 15*b* is a transmission line having an electrical length of λ. The microstrip resonators 12*c* and 12*d* are connected to the middle point of the strip line 15*b*. Thus, the ends of the microstrip resonator 12*b* and the microstrip resonator 12*c* are connected to each other via the λ/2 transmission line. The ends of the microstrip resonator 12*d* and the microstrip resonator 12*e* are connected to each other via the λ/2 transmission line.

Thus, the band-pass filter 10 which corresponds to the equivalent circuit shown in FIG. 4C can be formed.

Hereinafter, a parallel multistage band-pass filter according to a second embodiment of the present invention will be described with reference to FIGS. 10 to 13.

FIGS. 10 to 13 are equivalent circuit diagrams of parallel multistage band-pass filters, respectively, which are formed by connection of inductance elements or capacitance elements to the parallel multistage band-pass filter shown in FIG. 1.

In FIGS. 10 to 13, an input terminal 1, an output terminal 2, resonators F1 to Fn, transmission lines TL and TLa each having an electrical length equal to half of the wave length of a transmission signal, an inductance element L, and a capacitance element C are shown.

Figure 10:
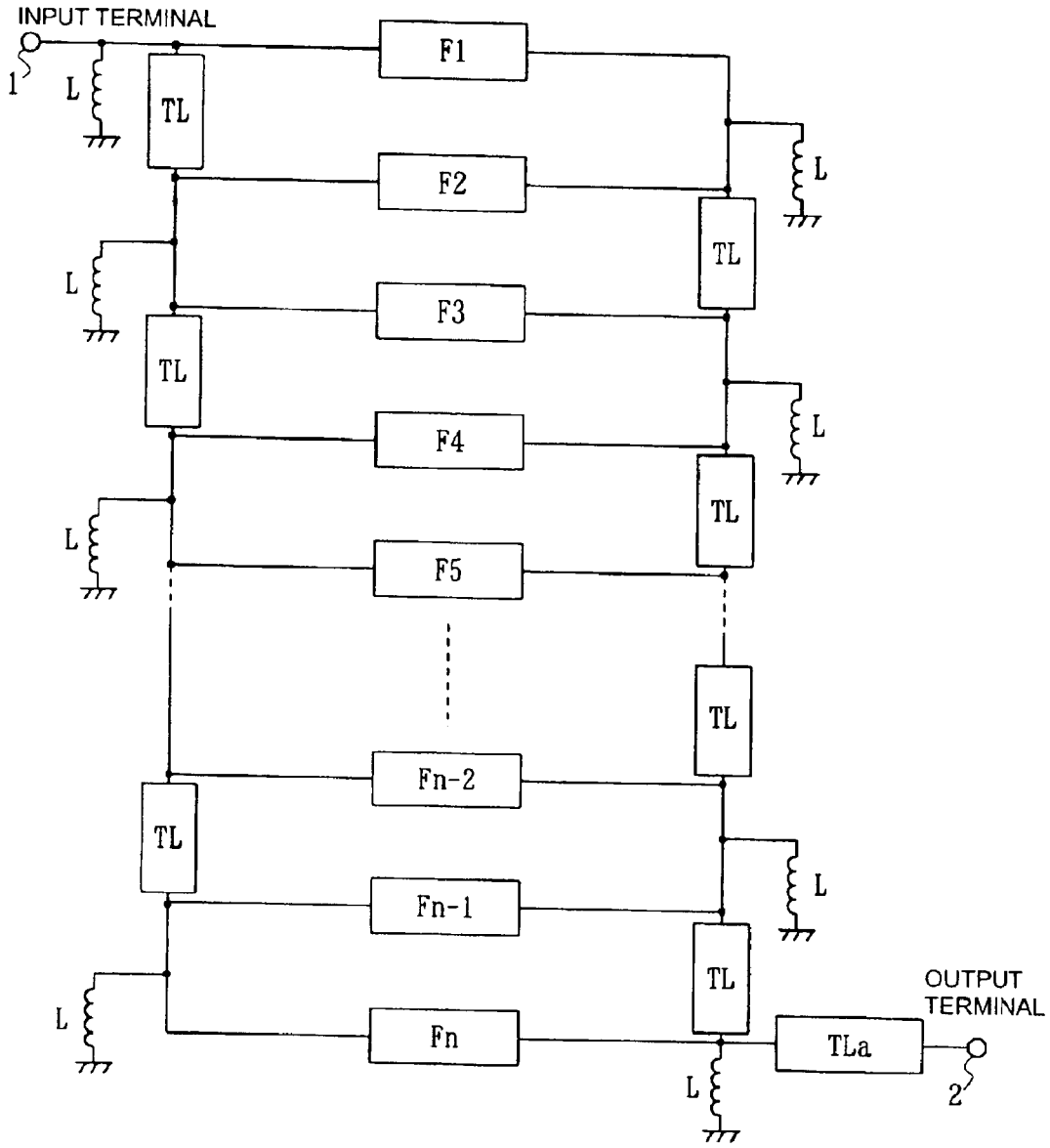
FIG. 10 is an equivalent circuit diagram of a parallel multistage band-pass filter according to a second embodiment of the present invention.

In the band-pass filter shown in FIG. 10, an inductance element L is connected between the port on the input terminal side of the (2n−1)th resonator numbered from the input terminal side and the ground. Moreover, an inductance L is connected between the port on the output terminal side of the (2n−1)th resonator numbered from the input terminal side and the ground. The other configuration is the same as that of the band-pass filter shown in FIG. 1.

Figure 11:
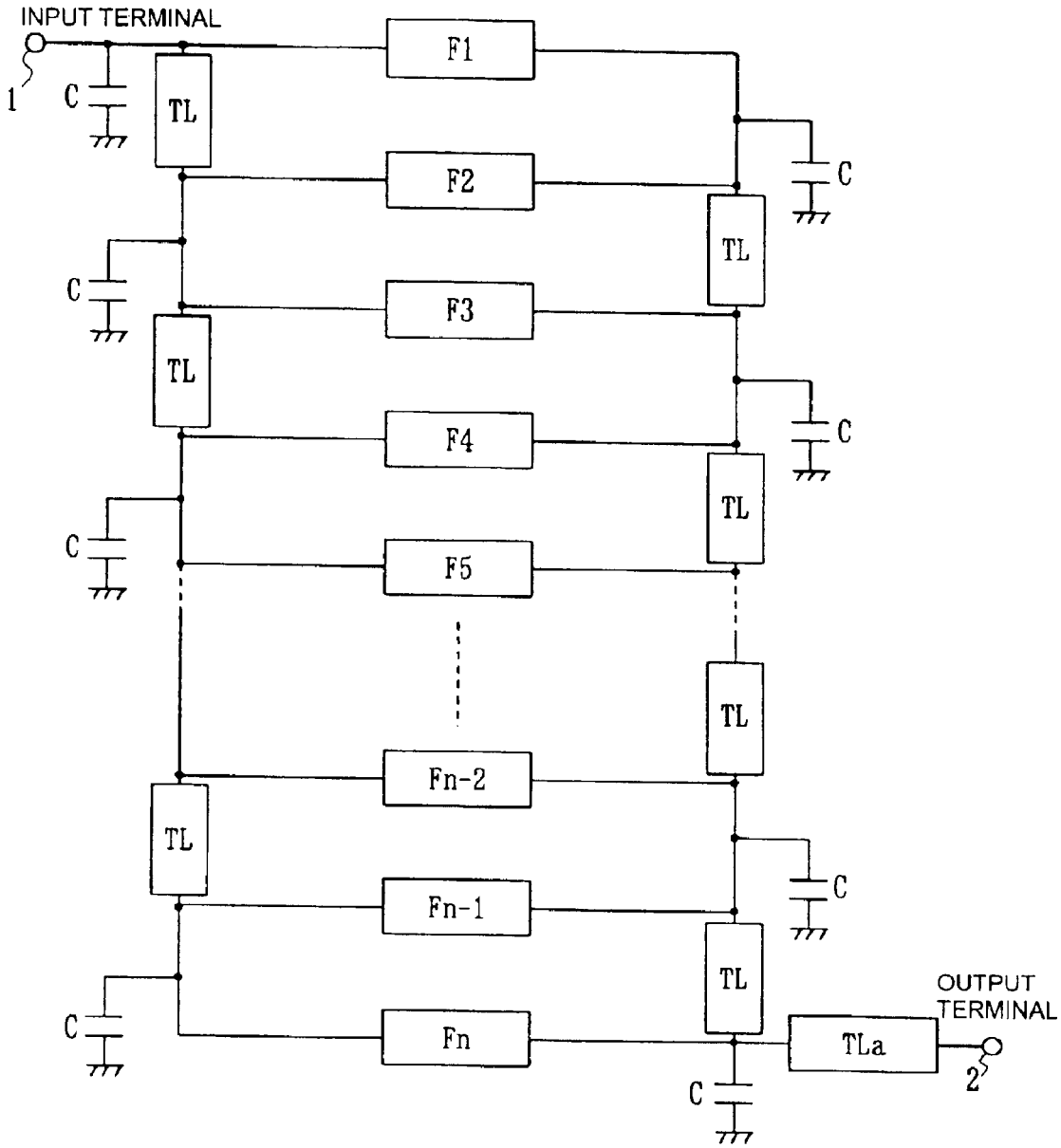
FIG. 11 is an equivalent circuit diagram of another parallel multistage band-pass filter according to the second embodiment of the present invention.

The circuit of the band-pass filter shown in FIG. 11 is the same circuit as that of the band-pass filter shown in FIG. 10 except that a capacitance element is used instead of the inductance element L.

Figure 12:
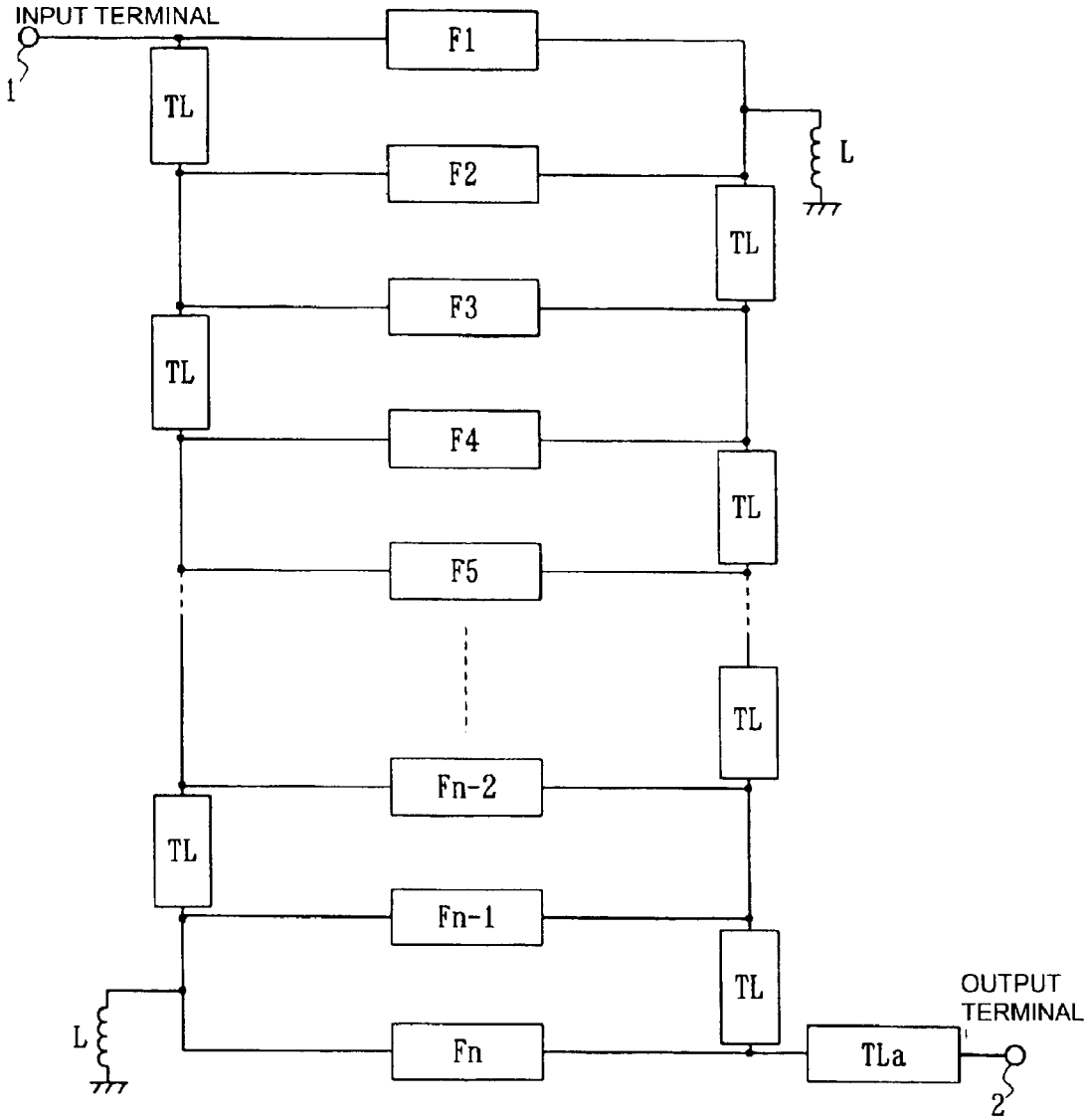
FIG. 12 is an equivalent circuit diagram of still another parallel multistage band-pass filter according to the second embodiment of the present invention.

In the band-pass filter shown in FIG. 12, an inductance element L is connected between the port on the output terminal side of the first resonator numbered from the input terminal side and the ground, and moreover, an inductance element L is connected between the port on the input terminal side of the first resonator numbered from the output terminal side and the ground. The other configuration of the band-pass filter of FIG. 12 is the same as that of the band-pass filter shown in FIG. 1.

Figure 13:
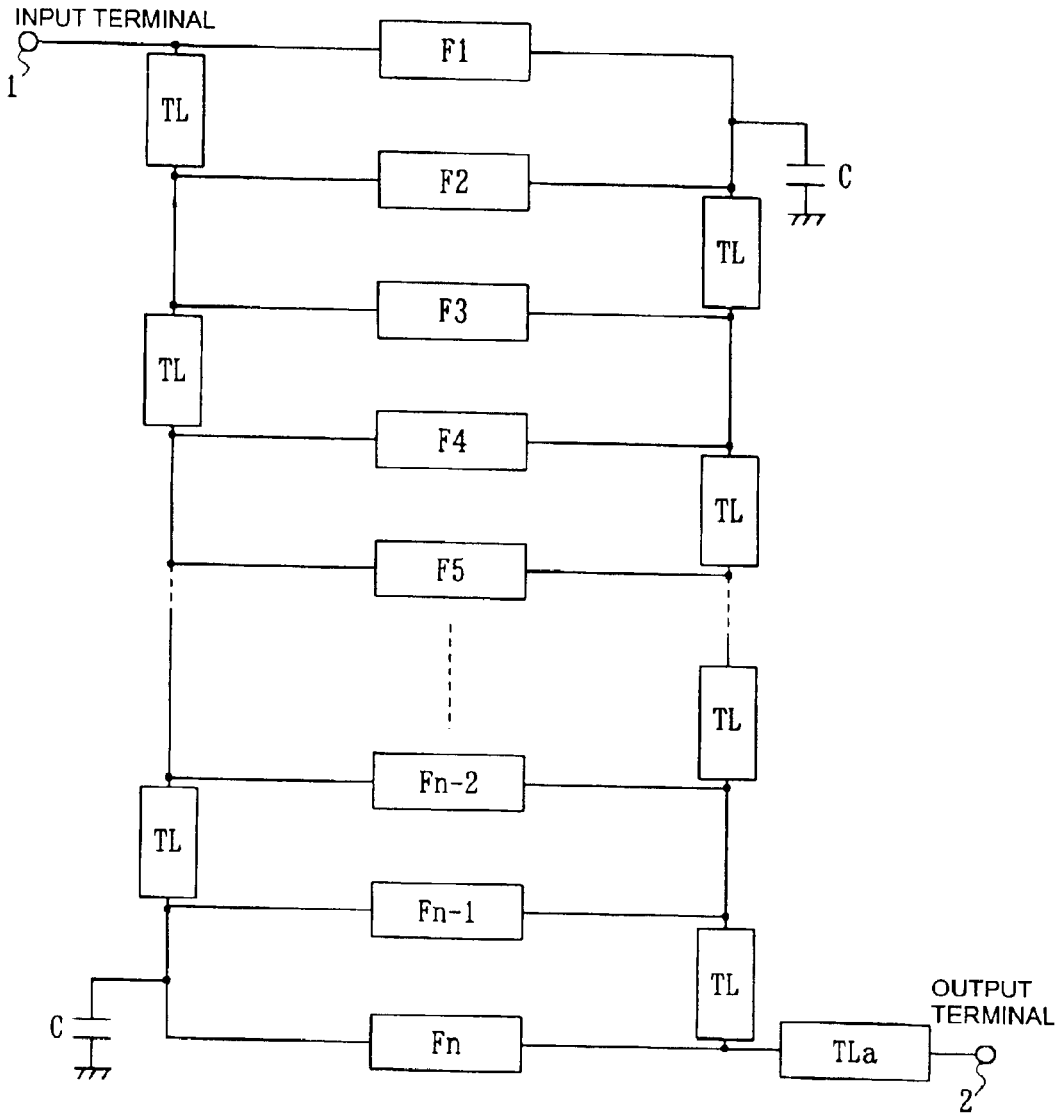
FIG. 13 is an equivalent circuit diagram of yet another parallel multistage band-pass filter according to the second embodiment of the present invention.

The band-pass filter shown in FIG. 13 is the same circuit as the band-pass filter of FIG. 12 except that capacitance elements C are used instead of the inductance elements L.

Thus, the phase-adjustment between the respective resonators can be easily performed, since the band-pass filter is provided with the inductance elements L or the capacitance elements C.

Hereinafter, the configuration of a parallel multistage band-pass filter according to a third embodiment of the present invention will be described with reference to FIG. 14.

Figure 14:
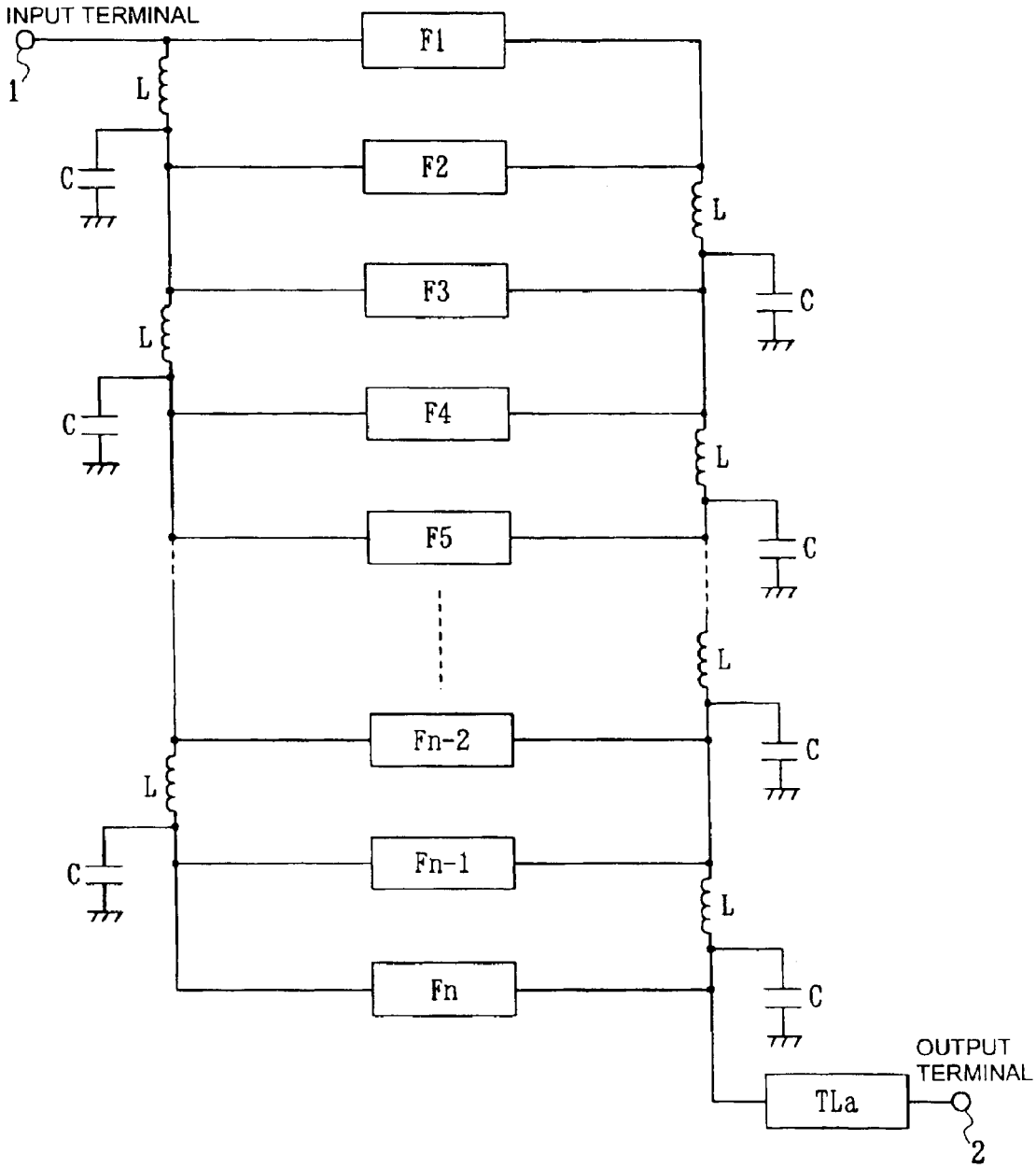
FIG. 14 is an equivalent circuit diagram of a parallel multistage band-pass filter according to a third embodiment of the present invention.

FIG. 14 is an equivalent circuit diagram of the parallel multistage band-pass filter.

In FIG. 14, an input terminal 1, an output terminal 2, resonators F1 to Fn, an inductance element L, and a capacitance element C are shown.

In the band-pass filter having the equivalent circuit shown in FIG. 14, a lumped constant circuit, comprising a lumped constant inductance element L connected between resonators and a capacitance element C connected between the inductance element L and the ground, is used instead of each of the transmission lines TL of the band-pass filter shown in FIG. 1. The other configuration of the band-pass filter of FIG. 14 is the same as that of the band-pass filter of FIG. 1.

As described above, the circuit may be formed using a lumped constant line in which the lumped constant element is used as a transmission line.

Hereinafter, the configuration of a parallel multistage band-pass filter according to a fourth embodiment of the present invention will be described with reference to FIGS. 15 and 16.

Figure 15:
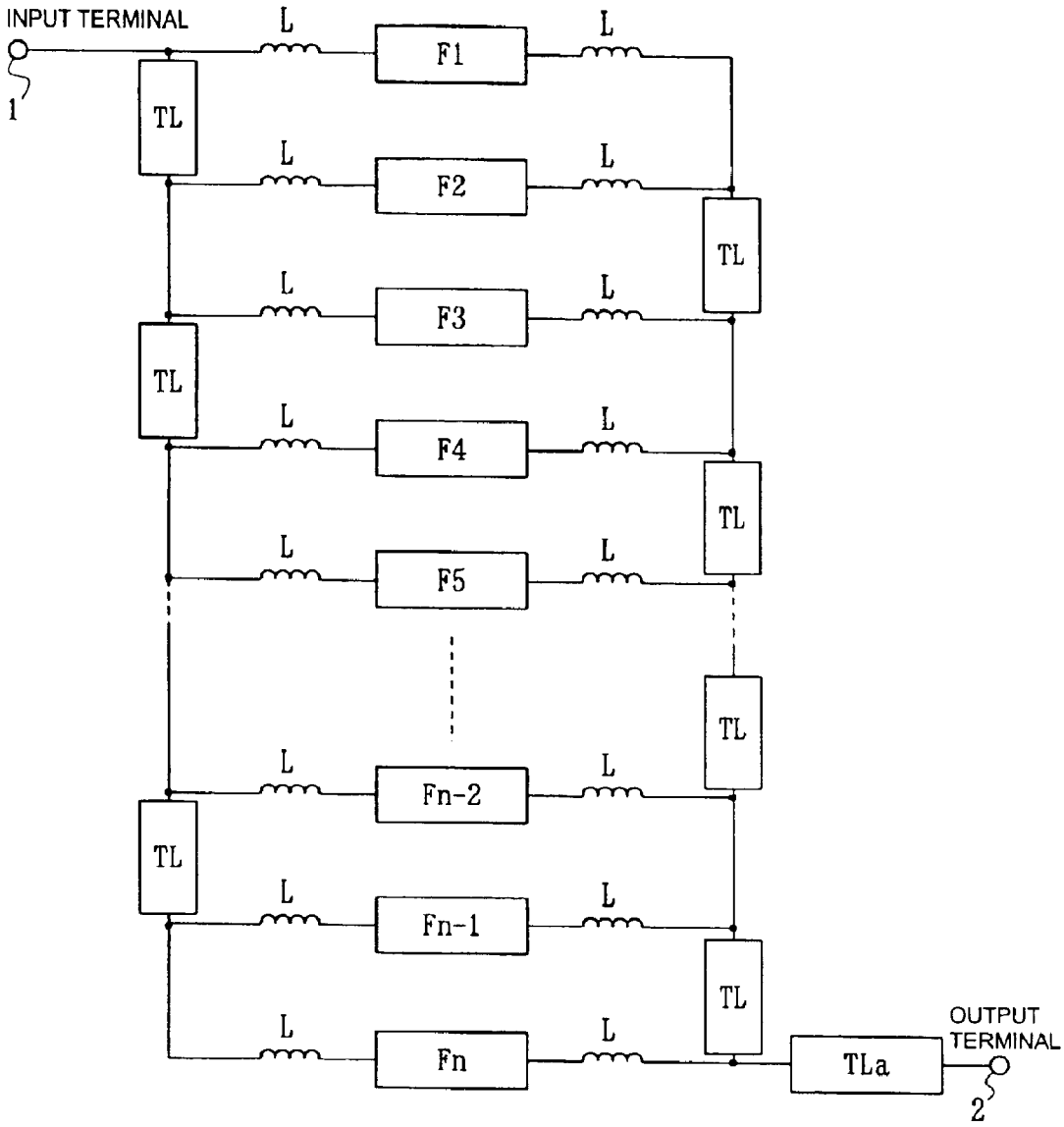
FIG. 15 is an equivalent circuit diagram of a parallel multistage band-pass filter according to a fourth embodiment of the present invention.
Figure 16:
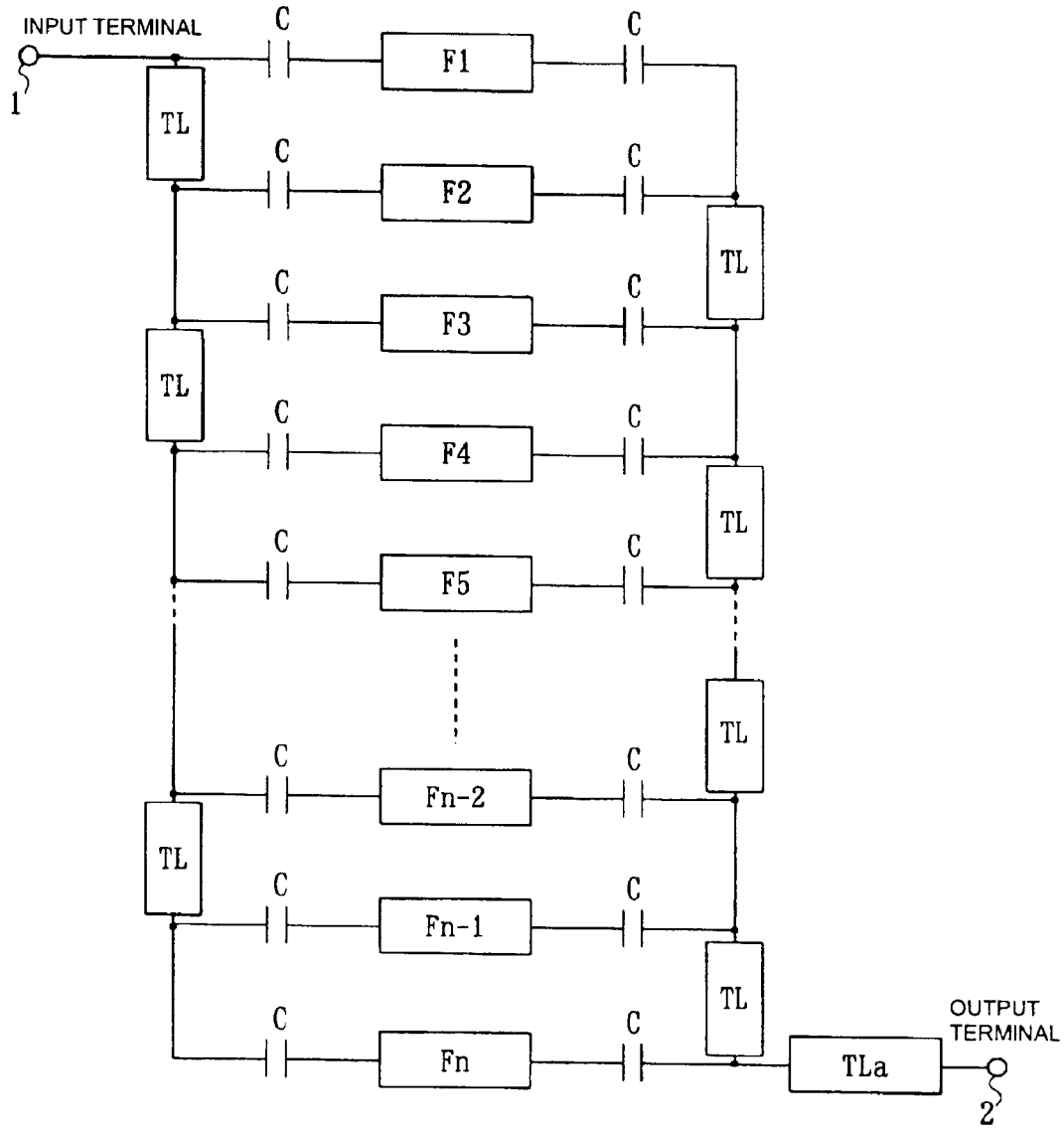
FIG. 16 is an equivalent circuit diagram of another parallel multistage bandpass filter according to the fourth embodiment of the present invention.

FIGS. 15 and 16 are equivalent circuit diagrams of parallel multistage band-pass filters. In FIG. 15, inductance elements L are used in the excitation portions of each resonator. In FIG. 16, capacitance elements C are used in the excitation portions of each resonator.

In the band-pass filter shown in FIG. 15, the inductance elements L are used in the excitation portions of each resonator, i.e., in the connection portions between a resonator and the transmission lines. The other configuration of the parallel multistage band-pass filter of FIG. 15 is the same as that of the band-pass filter of FIG. 1.

Similarly, in the band-pass filter shown in FIG. 16, the capacitance elements C are used in the excitation portions of each resonator. The other configuration of the band-pass filter of FIG. 16 is the same as that of the band-pass filter of FIG. 1.

With this configuration, matching of the resonator and the transmission lines can be easily performed.

Hereinafter, examples of the configurations of these parallel multistage bandpass filters will be described with reference to FIGS. 17A, 17B, and 17C. The configurations described below satisfy both of the features of the equivalent circuit shown in FIG. 16 and those of the equivalent circuit shown in FIG. 12. In particular, capacitance elements are used in the excitation portions of each resonator, and inductance elements are connected to the port on the output terminal side of the first resonator numbered from the input terminal side and to the port on the input terminal side of the first resonator numbered from the output terminal side, and are grounded, respectively.

Figure 17A:
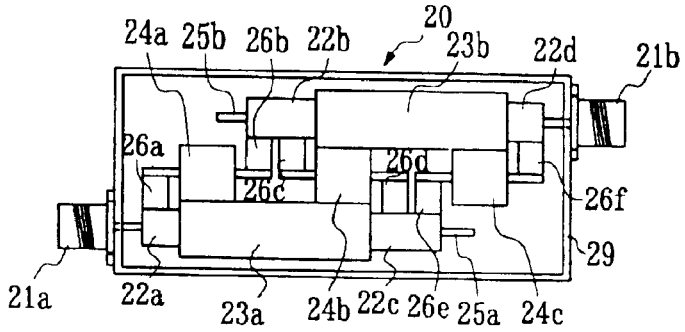
FIG. 17A is a schematic view showing the configuration of a parallel three-stage band-pass filter.

FIG. 17A shows the configuration of a parallel three-stage band-pass filter. FIG. 17B shows the configuration of a parallel four-stage band-pass filter. FIG. 17C shows the configuration of a parallel five-stage band-pass filter.

Figure 17B:
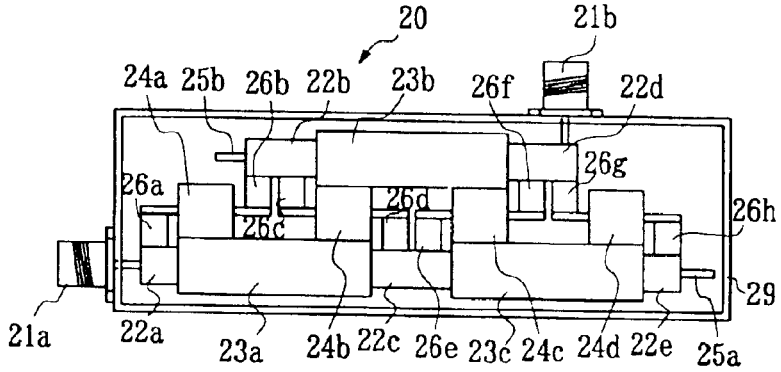
FIG. 17B is a schematic view showing the configuration of a parallel four-stage band-pass filter.
Figure 17C:
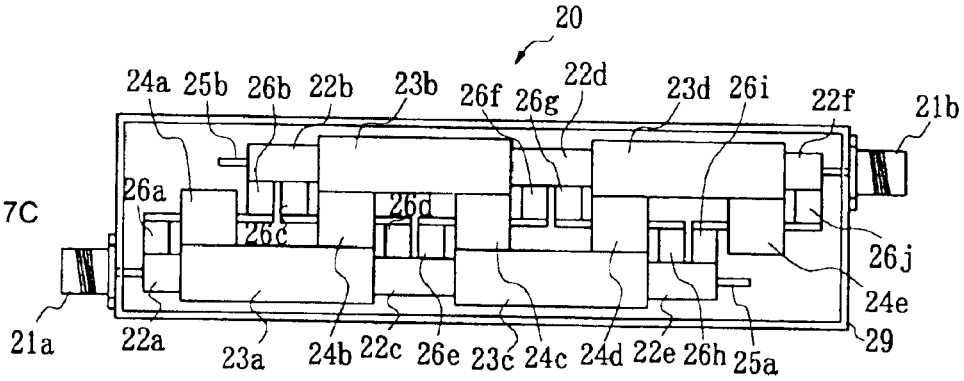
FIG. 17C is a schematic view showing the configuration of a parallel five-stage band-pass filter.

In FIGS. 17A, 17B, and 17C, a parallel multistage band-pass filter 20, coaxial connectors 21*a* and 21*b*, core conductors 22*a* to 22*f*, dielectric coaxial lines 23*a* to 23*d*, dielectric coaxial resonators 24*a* to 24*e*, inductance elements 25*a* and 25*b*, capacitance elements 26*a* to 26*j*, and a case 29 are shown.

As shown in FIG. 17A, the coaxial connectors 21*a* and 21*b* are installed on the opposite sides of the case 29. The dielectric coaxial resonators 23*a* and 23*b*, which have an electrical length of half of the wavelength of a transmission signal, are arranged in the case 29 and are connected to the coaxial connectors 21*a* and 21*b* via the core conductors 22*a* and 22*d*, respectively. The core conductors 22*b* and 22*c* of the dielectric coaxial resonators 23*a* and 23*b* are grounded via the inductance elements 25*a* and 25*b*, respectively.

The dielectric coaxial resonators 24*a*, 24*b*, and 24*c* have an electrical length of about half of the wavelength of a transmission signal, and are formed so as to have adjacent resonance frequencies. The dielectric coaxial resonator 24*a* is connected to the core conductors 22*a* and 22*b* via the capacitance elements 26*a* and 26*b*, respectively. The dielectric coaxial resonator 24*b* is connected to the core conductors 22*b* and 22*c* via the capacitance elements 26*c* and 26*d*, respectively. Moreover, the dielectric coaxial resonators 24*c* is connected to the core conductors 22*c* and 22*d* via the capacitance elements 26*e* and 26*f*, respectively.

Figure 18:
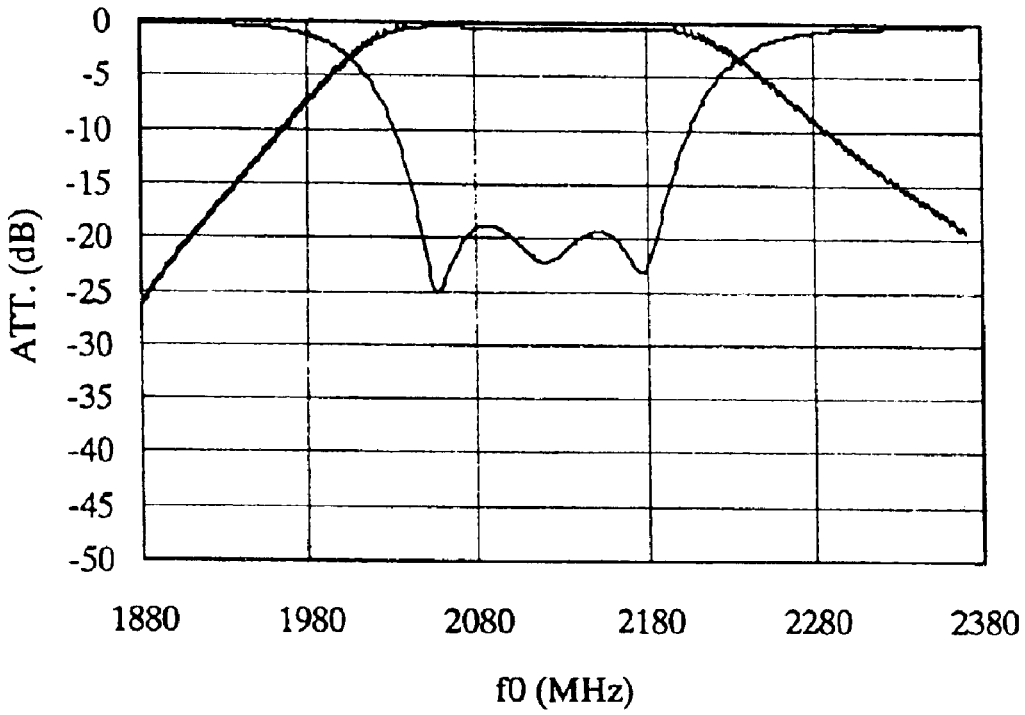
FIG. 18 is a graph showing the frequency characteristic of the parallel three-stage band-pass filter.
Figure 19:
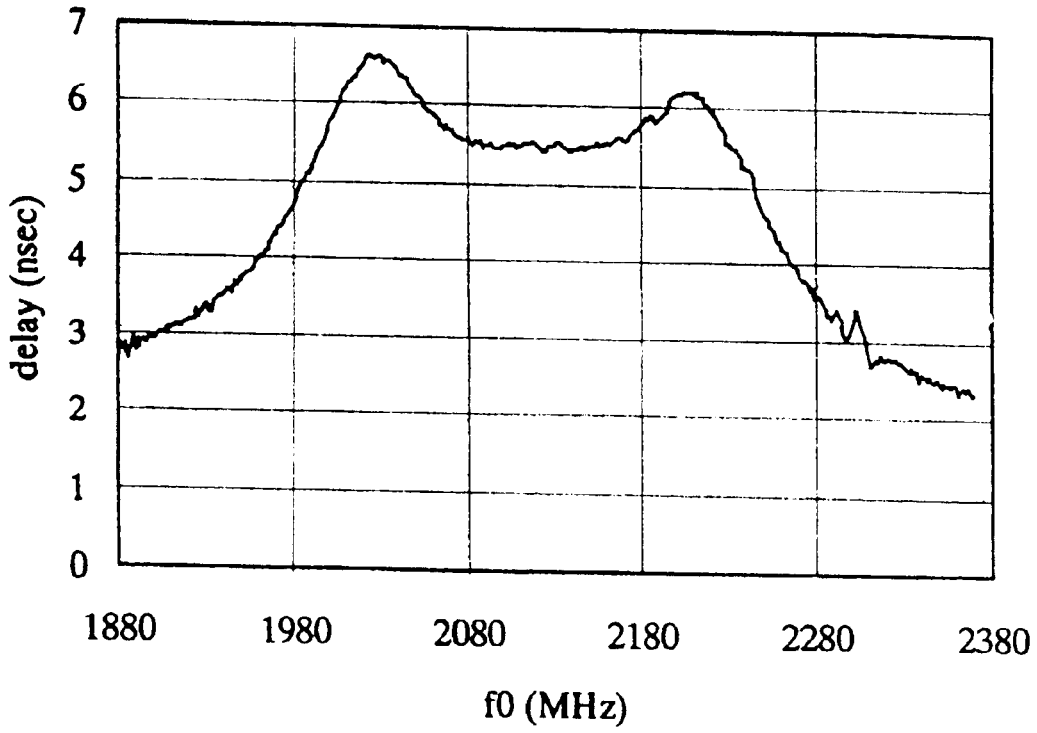
FIG. 19 is a graph showing the group delay characteristic of the parallel three-stage band-pass filter shown in FIG. 18.

FIG. 18 shows the frequency characteristic of the parallel three-stage band-pass filter of FIG. 17A. FIG. 19 shows the group delay characteristic thereof.

As seen in FIG. 18, a band-pass filter having a pass-band in the frequency range of about 2.08 to 2.18 GHz can be formed. The group delay characteristic curve has a substantially flat portion in the pass-band as shown in FIG. 19.

Since the dielectric coaxial lines and the dielectric resonators are used, a parallel multistage band-pass filter having a simple structure can be formed, due to the transmission lines having a low loss and the resonators having a small size.

In the parallel multistage band-pass filter 20 shown in FIG. 17B, the coaxial connectors 21*a* and 21*b* are installed on two sides, not opposite to each other, of the case 29. The dielectric coaxial resonators 23*a* and 23*b*, which have an electrical length of half of the wavelength of a transmission signal, are arranged in the case 29 and are connected to the coaxial connectors 21*a* and 21*b* via the core conductors 22*a* and 22*d*, respectively. The dielectric coaxial lines 23*a* and 23*c* are connected to each other via the common core conductor 22*c*. The core conductor 22*e* of the dielectric coaxial line 23*c* is connected to the inductance elements 25, and is grounded. The core conductor 22*b* of the dielectric coaxial line 23*b* is connected to the inductance element 25*b*, and is grounded.

The dielectric coaxial resonators 24*a*, 24*b*, 24*c*, and 24*d* have an electrical length of about half of the wavelength of a transmission signal, and are formed so as to have adjacent resonance frequencies, respectively. The dielectric coaxial resonator 24*a* is connected to the core conductors 22*a* and 22*b* via the capacitance elements 26*a* and 26*b*, respectively. The dielectric coaxial resonator 24*b* is connected to the core conductors 22*b* and 22*c* via the capacitance elements 26*c* and 26*d*, respectively. The dielectric coaxial resonator 24*c* is connected to the core conductors 22*c* and 22*d* via the capacitance elements 26*e* and 26*f*, respectively. The dielectric coaxial resonator 24*d* is connected to the core conductors 22*d* and 22*e* via the capacitance elements 26*g* and 26*h*, respectively.

Thus, the parallel four-stage band-pass filter can be configured as described above.

In the parallel multistage band-pass filter 20 shown in FIG. 17C, the coaxial connectors 21*a* and 21*b* are installed on opposite sides of the case 29. The dielectric coaxial resonators 23*a* and 23*b*, which have an electrical length of half of the wavelength of a transmission signal, are arranged in the case 29 and are connected to the coaxial connectors 21*a* and 21*b* via the core conductors 22*a* and 22*f* thereof, respectively. The dielectric coaxial lines 23*a* and 23*c* are connected to each other via the common core conductor 22*c*. The dielectric coaxial lines 23*b* and 23*d* are connected to each other via the common core conductor 22*d*. The core conductor 22*e* of the dielectric coaxial line 23*c* is connected to the inductance element 25, and is grounded. The core conductor 22*b* of the dielectric coaxial line 23*b* is connected to the inductance element 25*b*, and is grounded.

The dielectric coaxial resonators 24*a*, 24*b*, 24*c*, 24*d*, and 24*e* have an electrical length of about half of the wavelength of a transmission signal, and are formed so as to have adjacent resonance frequencies, respectively. The dielectric coaxial resonator 24*a* is connected to the core conductors 22*a* and 22*b* via the capacitance elements 26*a* and 26*b*, respectively. The dielectric coaxial resonator 24*b* is connected to the core conductors 22*b* and 22*c* via the capacitance elements 26*c* and 26*d*, respectively. The dielectric coaxial resonator 24*c* is connected to the core conductors 22*c* and 22*d* via the capacitance elements 26*e* and 26*f*, respectively. The dielectric coaxial resonator 24*d* is connected to the core conductors 22*d* and 22*e* via the capacitance elements 26*g* and 26*h*, respectively. The dielectric coaxial resonator 24*e* is connected to the core conductors 22*e* and 22*f* via the capacitance elements 26*i* and 26*j*, respectively.

Thus, the parallel five-stage band-pass filter can be configured as described above.

Moreover, a composite filter device can be formed by providing a plurality of the above-described parallel multistage band-pass filters. In particular, the composite filter device comprising a plurality of filters can be easily formed by using, as a commonly used terminal, one of the input-output terminals (the input terminal or the output terminal) of each band-pass filter. For example, a duplexer can be formed by using two filters. A triplexer can be formed by using three filters.

It is to be noted that in the above-described embodiments, the input terminal may be caused to function as an output terminal, while the output terminal may be caused to function as an input terminal. Also, in this case, the same advantages as described above can be obtained.

Hereinafter, an amplifier device according to a fifth embodiment of the present invention will be described with reference to FIG. 20.

Figure 20:
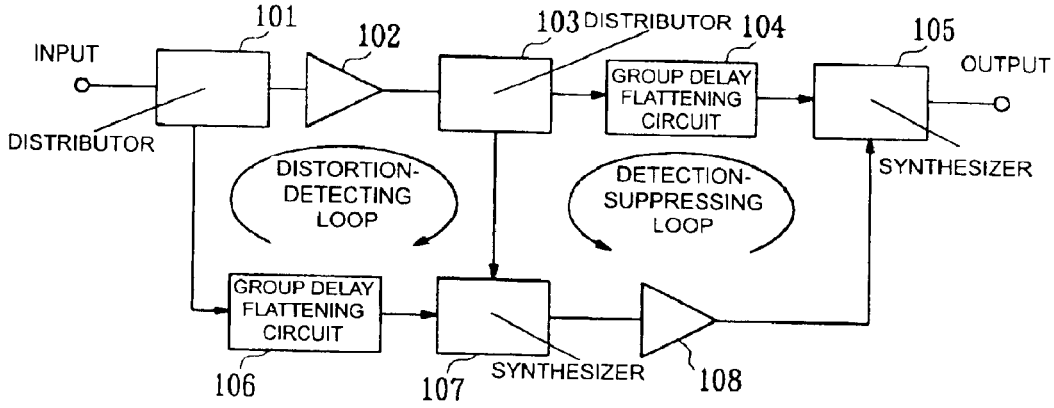
FIG. 20 shows an amplifier device according to a fifth embodiment of the present invention.

FIG. 20 is a block diagram of a distortion-compensation type amplifier device, which is a feed-forward type amplifier. In this amplifier device, a distributor 101 distributes an input signal. An amplifier 102 amplifies the signal distributed via the distributor 101, and outputs the amplified signal to a distributor 103. A group delay flattening circuit 106 delays the signal distributed via the distributor 101 and feeds the delayed signal to a synthesizer 107. The distributor 103 distributes the signal from the amplifier 102. The synthesizer 107 combines the signal fed from the distributor 103 with the signal fed from the group delay flattening circuit 106 and outputs the combined signal to an amplifier 108. The amplifier 108 amplifies the signal and feeds it to a synthesizer 105. The synthesizer 105 combines the signal fed from the group delay flattening circuit 104 with the signal fed from the amplifier 108 to output the synthesized signal.

The distributor 101, the amplifier 102, the distributor 103, the synthesizer 107, and the group delay flattening circuit 106 constitute a distortion-detecting loop. In particular, the signal fed from the distributor 103 to the synthesizer 107 and the signal fed from the group delay flattening circuit 106 to the synthesizer 107 are combined, and the combination result corresponds to a signal which is proportional to the distortion component generated by the amplifier 102. The distributor 103, the group delay flattening circuit 104, the synthesizer 105, the synthesizer 107, and the amplifier 108 constitute a distortion-suppressing loop. That is, a distortion component output from the synthesizer 107 is amplified by the amplifier 108, and is fed to the synthesizer 105 as a distortion-suppressing signal. Thereby, the non-linear distortion component generated by the amplifier 102 is cancelled out. In this case, the delay time of the group delay flattening circuit 106 is set so that a signal can be input to the synthesizer 107 at the same delay time as that of the signal route containing the amplifier 102. Moreover, the delay time of the group delay flattening circuit 104 is set so that the distortion suppressing signal can be combined in the reversed phase by means of the synthesizer 105.

The above-described parallel multistage band-pass filters can be used as the group delay flattening circuits of this amplifier device. Thus, the amplifier device having a simple configuration and superior group delay and attenuation characteristics can be produced at a low cost.

A communication device for use in a base station according to a sixth embodiment of the present invention will be described below.

Figure 21:
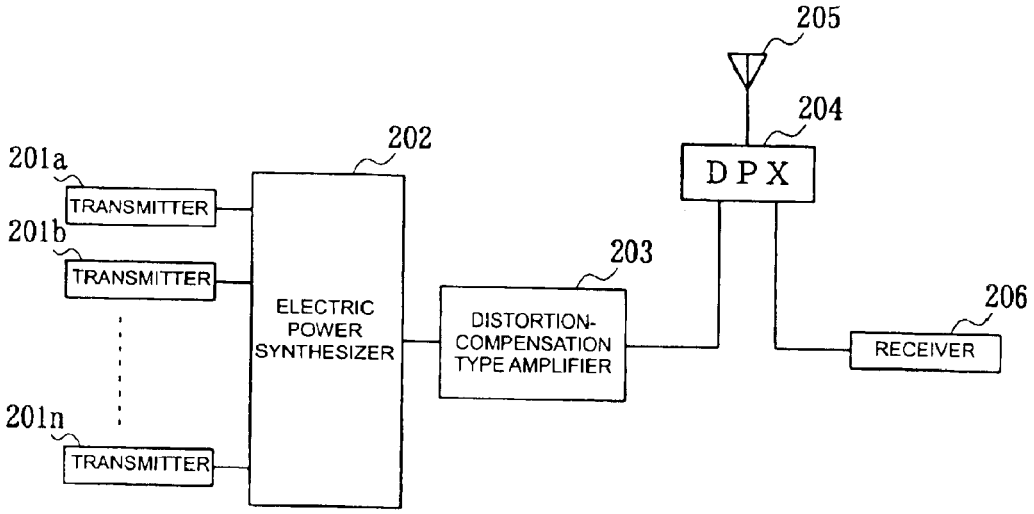
FIG. 21 shows a communication device according to a sixth embodiment of the present invention.

FIG. 21 is a block diagram of the communication device. Radio channel signals transmitted via a plurality of transmitters 201*a* to 201*n* are power-combined by a power synthesizer 202. Different distortions are superposed in the power-combined signal, which is input to a distortion compensation type amplifier 203. The amplifier 203 detects the signal, removes only the distortions, and outputs the signal to a duplexer DPX 204. The duplexer DPX 204 permits only the signal in the pass-band to be transmitted and output the signal externally via an antenna 205. The duplexer DPX 204 permits only the signal in the reception-band of a signal received via the antenna 205 to be output to a receiver 206.

The above-described parallel multistage band-pass filters or amplifier device can be used as the distortion-compensation type amplifier of the communication device. Thus, the communication device having a simple configuration and superior communication characteristics can be produced at a low cost.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A parallel multistage band-pass filter comprising:

a plurality of j resonators having adjacent resonance frequencies and connected in parallel to each other between an input terminal and an output terminal for a transmission signal in which, is a natural number greater than 1;

a first transmission line having an electrical length substantially equal to half of a wavelength of the transmission signal incorporated between a first port on an input terminal side of a (2n−1)th resonator of the plurality of resonators numbered from the input terminal side and a second port on an input terminal side of a (2n)th resonator of the plurality of resonators numbered from the input terminal side; and a second transmission line having an electrical length substantially equal to half of a wavelength of the transmission signal incorporated between a third port on an output terminal side of the (2n)th resonator of the plurality of resonators numbered from the input terminal side and a fourth port on an output terminal side of a (2n+1)th resonator of the plurality of resonators numbered from the input terminal side, in which n is a natural number, wherein a number of transmission lines in the band-pass filter is equal to j−1 n a substantially $\lambda/2$ line equivalent.

2. The parallel multistage band-pass filter according to claim 1, wherein at least one reactance element is connected between a ground and one of the input and output terminals.

3. The parallel multistage band-pass filter according to claim 1, wherein at least one reactance element is connected in series with an excitation element of at least one of the plurality of resonators.

4. The parallel multistage band-pass filter according to claim 1, wherein at least one of the first and second transmission lines is a dielectric coaxial line.

5. The parallel multistage band-pass filter according to claim 1, wherein at least one of the first and second transmission lines is a microstrip line.

6. The parallel multistage band-pass filter according to claim 1, wherein at least one of the first and second transmission lines is a lumped constant line comprising an inductance element and a capacitance element.

7. The parallel multistage band-pass filter according to claim 1, wherein at least one resonator of the plurality of resonators is a dielectric coaxial resonator.

8. The parallel multistage band-pass filter according to claim 1, wherein at least one resonator of the plurality of resonators is a microstrip resonator.

9. An amplifier device including the parallel multistage band-pass filter defined in claim 1.

10. A communication device comprising the parallel multistage band-pass filter defined in claim 1.

11. A parallel multistage band-pass filter comprising:

a plurality of j resonators having adjacent resonance frequencies and connected in parallel to each other between an input terminal and an output terminal for a transmission signal in which is a natural number greater than 1;

a first transmission line having an electrical length substantially equal to half of a wavelength of the transmission signal incorporated between a first port on an output terminal side of a (2n−1)th resonator of the plurality of resonators numbered from the output terminal side and a second port on an output terminal side of a (2n)th resonator of the plurality of resonators numbered from the output terminal side; and a second transmission line having an electrical length substantially equal to half of a wavelength of the transmission signal incorporated between a third port on an input terminal side of the (2n)th resonator of the plurality of resonators numbered from the output terminal side and a fourth port on an input terminal side of a (2n+1)th resonator of the plurality of resonators numbered from the output terminal side, in which n is a natural number, wherein a number of transmission lines in the band-pass filter is equal to j−1 in a substantially $\lambda/2$ line equivalent.

12. The parallel multistage band-pass filter according to claim 11, wherein at least one reactance element is connected between a ground and one of the input and output terminals.

13. The parallel multistage band-pass filter according to claim 11, wherein at least one reactance element is connected in series with an excitation element of at least one of the plurality of resonators.

14. The parallel multistage band-pass filter according to claim 11, wherein at least one of the first and second transmission lines is a dielectric coaxial line.

15. The parallel multistage band-pass filter according to claim 11, wherein at least one of the first and second transmission lines is a microstrip line.

16. The parallel multistage band-pass filter according to claim 11, wherein at least one of the first and second transmission lines is a lumped constant line comprising an inductance element and a capacitance element.

17. The parallel multistage band-pass filter according to claim 11, wherein at least one resonator of the plurality of resonators is a dielectric coaxial resonator.

18. The parallel multistage band-pass filter according to claim 11, wherein at least one resonator of the plurality of resonators is a microstrip resonator.

19. An amplifier device including the parallel multistage band-pass filter defined in claim 11.

20. A communication device comprising the parallel multistage band-pass filter defined in claim 11.

* * * * *